US005504272A

United States Patent [19]

Uchiyama et al.

[11] Patent Number: 5,504,272

[45] Date of Patent: Apr. 2, 1996

[54] MAGNETIC TONER HAVING DEFINED PARTICLE DISTRIBUTION

[75] Inventors: Masaki Uchiyama, Ichikawa; Hirohide Tanikawa; Yasutaka Akashi, both of Yokohama; Masaaki Taya, Kawasaki; Makoto Unno, Tokyo, all of Japan

[73] Assignee: Canon Kabushiki Kaisha, Tokyo, Japan

[21] Appl. No.: 246,754

[22] Filed: May 20, 1994

Related U.S. Application Data

[62] Division of Ser. No. 763,253, Sep. 20, 1991, Pat. No. 5,338,894.

[30] Foreign Application Priority Data

Sep. 21, 1990 [JP] Japan ..... 2-250109
Sep. 21, 1990 [JP] Japan ..... 2-250110

[51] Int. Cl.[6] ..... G03G 15/08

[52] U.S. Cl. ..... 118/653; 430/106.6; 430/111

[58] Field of Search ..... 118/653, 656, 118/657, 658; 430/105, 106, 106.6, 107, 108, 109, 110, 111, 120–123; 355/247, 251, 252, 253, 254

[56] References Cited

U.S. PATENT DOCUMENTS

| | | | |
|---|---|---|---|
| 2,297,691 | 10/1942 | Carlson | 95/5 |
| 3,405,682 | 10/1968 | King et al. | 118/637 |
| 3,866,574 | 2/1975 | Hardenrook et al. | 118/637 |
| 3,890,929 | 6/1975 | Walkup | 118/637 |
| 3,893,418 | 7/1975 | Liebman et al. | 118/637 |
| 4,071,361 | 1/1978 | Marushima | 96/1.4 |
| 4,504,563 | 3/1985 | Tinaka et al. | 430/109 |
| 4,946,755 | 8/1990 | Inoue | 430/106.6 |
| 4,952,476 | 8/1990 | Sakashita et al. | 430/106.6 |
| 4,957,840 | 9/1990 | Sakashita et al. | 430/106.6 |
| 5,338,894 | 8/1994 | Uchiyama et al. | 118/653 |

FOREIGN PATENT DOCUMENTS

| | | | |
|---|---|---|---|
| 55-18656 | 2/1980 | Japan | G03G 13/08 |
| 55-18657 | 2/1980 | Japan | G03G 13/08 |
| 55-18658 | 2/1980 | Japan | G03G 13/08 |
| 55-18659 | 2/1980 | Japan | G03G 13/08 |
| 55-134861 | 10/1980 | Japan | G03G 9/08 |
| 58-189646 | 11/1983 | Japan | G03G 9/08 |
| 59-139053 | 8/1984 | Japan | G03G 9/08 |
| 60-73647 | 4/1985 | Japan | G03G 15/06 |
| 61-123856 | 6/1986 | Japan | G03G 9/08 |
| 61-123857 | 6/1986 | Japan | G03G 9/08 |
| 62-280758 | 12/1987 | Japan | G03G 9/08 |

*Primary Examiner*—Kristine L. Kincaid
*Assistant Examiner*—Christopher Horgan
*Attorney, Agent, or Firm*—Fitzpatrick, Cella, Harper & Scinto

[57] ABSTRACT

An image forming method in which a toner-carrying member for carrying a specific magnetic toner is placed adjacent a latent image-bearing member for carrying an electrostatic latent image so as to form a developing region of a predetermined gap size. The magnetic toner on the toner-carrying member forms a toner layer of a regulated thickness smaller than the above-mentioned gap. An asymmetric bias is applied to the magnetic toner so as to cause the magnetic toner from the toner-carrying member to be conveyed to the latent image-bearing member thereby to develop the electrostatic latent image.

11 Claims, 7 Drawing Sheets

RESULT OF MEASUREMENT OF CHARGE AMOUNT DISTRIBUTION

MAGNETIC TONER HAVING DEFINED PARTICLE DISTRIBUTION

This is application is a division of application Ser. No. 07/763,253 filed Sep. 20, 1991, now U.S. Pat. No. 5,338, 894.

BACKGROUND OF THE INVENTION

2. Field of the Invention

The present invention relates to an image forming method which is used in recording or printing process such as electrophotographic processing, electrostatic printing and electrostatic recording.

2. Description of the Related Art

Hitherto, various types of electrophotographic processes have been known such as those disclosed in U. S. Pat. No. 2,297,691, Japanese Patent Publication No. 42-23910, corresponding to U.S. Pat. No. 3,666,363 and Japanese Patent Publication No. 43-24748, corresponding to U.S. Pat. No. 4,071,361. In general, these known electrophotographic processes employ a photoconductive material on which an electrical latent image is formed by various means. The latent image is then developed into a visible image by means of a toner and the developed image is transferred as required to a transfer member such as a sheet of paper, followed by fixing which is conducted by application of heat, pressure, heat and pressure or solvent vapor, whereby a copy image is obtained.

Developing methods in which images are developed under influence of a bias voltage are disclosed in U.S. Pat. Nos. 3,866,574, 3,890,929 and 3,893,418.

A method also has been proposed which uses a high-resistance mono-component toner, wherein a specific gap is preserved between a latent image carrier and a toner carrier and an asymmetric alternating pulse bias voltage is applied between the latent image carrier and the toner carrier so as to control conveyance of the toner. FIG. 9 schematically shows the waveform of the alternating pulse bias voltage used in this control method. More specifically, in this method, the gap between the latent image carrier and the toner carrier is approximately 50 to 500 μm, preferably 50 to 180 μm, and the frequency of the pulse bias voltage is approximately from 1.5 to 10 KHz, preferably 4 to 8 KHz. The developing time $T_A$ is approximately from 10 to 200 μsec, preferably from 30 to 200 μsec, while peeling or reverse-development time $T_D$ in which the toner is peeled off the latent image carrier is set to from about 100 to 500 μsec, preferably from 100 to 180 μsec. The developing voltage is determined to be lower than about −150 V, preferably between −150 V and −200 V, while the reverse-development or peeling voltage, which is of inverse polarity to the developing pulse and which acts to peel the toner off the latent image carrier, is determined to be higher than about 400 V, preferably between 400 V and 450 V.

This method effectively improves gradation and reproducibility while preventing deposition of the toner being conveyed to non-image area of the image carrier. FIG. 10 schematically illustrates the manner in which particles of the toner are conveyed.

Thus, in the above-described developing method, the absolute value of the alternating bias voltage is set to a low level and the developing voltage also is set to a low level, in order to prevent deposition of the toner particles to a non-image area. Unfortunately, however, this developing method often fails to provide high density of the developed images. There are some known developing methods which utilize high-resistance mono-component developing agents having volumetric resistance not lower than $10^{10}$ Ωcm. Examples of such methods are a so-called impression developing method as disclosed in U.S. Pat. No. 3,405,682 and a so-called jumping developing method as disclosed in Japanese Patent Laid-Open Nos. 55-18656 through 55-18659. In the jumping developing method, alternating bias voltage applied between the toner carrier and the latent image carrier causes the toner to reciprocate therebetween within the developing region where the distance between the toner carrier and the latent image carrier is smallest. The toner finally attaches selectively to the latent image carrier surface in accordance with the pattern of the latent image, thus developing the latent image into a visible image. As will be seen from FIG. 11, the alternating bias voltage has a duty ratio of 50%, i.e., the duration of the developing voltage component which acts to deposit the toner onto the latent image carrier surface and the duration of the peeling or reverse-development voltage component acting to peel the toner are equal to each other.

In a specific form of this jumping developing method, the duty ratio of the alternating bias voltage applied between the toner carrier and the latent image carrier is controlled in accordance with the amount of the toner remaining on the toner carrier, thereby allowing the density of the developed image to be altered as required, as disclosed in Japanese Patent Laid-Open No. 60-73647.

Copy images produced by the developing methods which utilize high resistance mono-component toner generally exhibit small degrees of gradation due to the fact that the high-potential region of the latent image is developed at a high density by virtue of the high developing voltage component while low-potential region of the latent image is not developed satisfactorily because the toner is excessively peeled off the latent image carrier due to application of an unduly high reverse-development voltage component of the alternating bias pulse voltage. Another drawback of this method is that the tolerance for setting the developing voltage component, which has a direct current (D.C.) component and an alternating current (A.C.) component, is impractically small. Namely, an attempt to raise the density level by lowering the level of the D.C. component or elevating the level of the A.C. component tends to cause fogging in white blank areas. Increasing the frequency of the A.C. component is an effective measure for suppressing generation of fog but this method seriously deteriorates reproducibility due to excessive thinning of character and line images.

In order to overcome the above-described problems, a method has been proposed in which the level of the developing electric field during application of the developing voltage component is enhanced and the duration of this component is shortened, thereby simultaneously attaining high image density, high gradation and good image quality without fog.

It has been noted, however, that this proposed method is still unsatisfactory in that it allows a deterioration of the image quality such as a reduction in the image density and increase in the fog, as well as degradation in resolution and line reproducibility, when this developing method is executed repeatedly for a long period of time. It has been proved that the deterioration of the image quality is attributable to a change in the particle size distribution of the toner caused by selective consumption of toner particles during long use.

One of the advantageous features of the developing devices which perform development by the previously described developing method is that the size of such developing devices can be made appreciably small, allows margin spaces to be generated around the photosensitive member as the latent image carrier, particularly in high-speed copying machines. This enables a plurality of such small developing devices having color toners other than black to be disposed around the photosensitive member so as to make it possible to change the recording color by a simple change-over operation. Furthermore, by employing this developing material it becomes easier to simultaneously conduct formation of latent images by an analog light, formation of latent images of page numbers and characters by laser light and to simultaneously develop these latent images.

The toner used in the developing method of the type described is required to have higher stability in the charged state against environmental conditions than other types of toners, in order to attain superior quality,durability and stability of the copy images.

Furthermore, the current trend for higher speed of operation of copying machines have given rise to a demand for toners which satisfy various requirements such as high resolution, high developing speed and superior durability. Studies are being made to develop toners which satisfy such requirements.

Among various types of toners, a toner known as magnetic toner contains a magnetic material which occupies a large part, e.g., 20 to 70 wt %, of the whole toner. Thus, the performance of magnetic toner significantly depends on the nature of the magnetic material.

A magnetic toner containing 16 to 25 wt% of FeO as magnetic powder, which is disclosed in Japanese Patent Laid-Open No. 58-189646 corresponding to U.S. Pat. No. 4,946,755, offers high efficiency development of electrostatic latent images, as well as high efficiency of image transfer, and ensures a high degree of stability of the toner image. However, it is not easy to attain high degrees of resolution, developing speed and durability with this type of magnetic toner, particularly when this type of magnetic toner is used in a high-speed copying machine which produces 50 or more copies per minute. Namely, when this type of magnetic toner is used in such a high-speed copying machine, a difficulty is encountered in controlling the amount of charges on the magnetic toner, particularly in an environment of low temperature and low humidity. Consequently, reduction in the image density and fogging of the background are often experienced due to excessive charging of the magnetic toner. One measure for preventing excessive charging of the magnetic toner is to increase the content of the magnetic material in the magnetic toner. This solution, however, impairs fixing performance and, hence, is not preferred from the view point of application to high-speed copying machines.

Various methods and devices have been developed also for fixing toner images to sheets such as copy papers. They include the heat-press type fixing method and a device employing heat rollers. The heat roller has a surface which is repellent to toner. A sheet carrying a toner image is conveyed such that its image carrying surface is pressed by the toner-repellent surface of the heat roller, whereby the toner image is fixed. According to this method, since the heat roller surface makes a pressure contact with the toner image, the toner can be fused and fixed to the sheet at high efficiency, thus enabling a quick fixing of the image. This type of fixing method, therefore, can suitably be used in high-speed copying machines.

In order to further improve fixing performance in this type of fixing method, Japanese Patent Laid-Open No. 55-134861, corresponding to U.S. Pat. No. 4,504,563, proposes use of a toner containing a binding resin having an acidic component. This type of toner, however, is too sensitive to changes in environmental conditions such that it tends to be charged either insufficiently and excessively, when the humidity of the ambient air is high and low, respectively.

The presence in a toner of an acid anhydride groups serves to improve chargeability. With this knowledge, Japanese Patent Laid-Open Nos. 59-139053 and 62-280758 propose toners which contain a binding resin formed from a polymer having many acid anhydride groups. The polymer is mixed with and diluted by a different type of resin. This type of toner essentially requires that the resin having acid anhydride groups is uniformly dispersed in the binding resin, for otherwise undesirable effects, such as fogging, tend to occur during development due to non-uniform mutual charging of the toner particles. In addition, the resin binder of the type described above exhibits an unduly strong negative charging characteristic and, hence, cannot be used in toners having positive charging characteristic.

Further, Japanese Patent Laid-Open Nos. 61-123856 and 61-123857 propose a method in which acid anhydride group units are dispersed,through copolymerization, in the polymer chains of the binding resin. Toners produced by this method exhibit superior fixing characteristics, as well as anti-offset and developing performance, but are liable to be charged excessively, particularly when used in high-speed machines in air of low humidity, thereby causing fogging and reduction in image density. One of the causes for such excessive charging is that, although the binding resin has abundant acid anhydride group units, these units are not dispersed uniformly.

SUMMARY OF THE INVENTION

Accordingly, an object of the present invention is to provide an image forming method which develops a latent image with a magnetic toner under an asymmetric developing bias voltage and which overcomes the above-described problems in the known art.

Another object of the present invention is to provide an image forming method which can be conducted in a high-speed copying machine and which can stably form a magnetic toner image of high image density, without fog, even after extended operation of the copying machine.

Still another object of the present invention is to provide an image forming method which can form a magnetic toner image of a high degree of gradation and resolution, as well as providing superior reproducibility even for copied images of thin lines.

A further object of the present invention is to provide an image forming method which can form a magnetic toner image of high image density with improved stability even when the humidity of the ambient air is low.

A still further object of the present invention is to provide an image forming method in which an electrostatic latent image formed on an a-Si (amorphous silicon) photosensitive member can be efficiently developed into a visible image of high quality.

An additional object of the present invention is to provide an image forming method which can provide an image of high density even when an a-Si photosensitive member having a low surface potential is used.

A further object of the present invention is to provide an image forming method which can develop potential contrast on an a-Si photosensitive member with a high fidelity, even when the potential contrast is very small, thus realizing a high degree of gradation.

Yet another object of the present invention is to provide an image forming method which is superior in resolution and thin-line reproducibility, thus enabling development of delicate pattern in a latent image on an a-Si photosensitive member with a high degree of fidelity.

A still further object of the present invention is to provide an image forming method which offers high developing speed and durability employing an a-Si photosensitive member.

To these ends, according to one aspect of the present invention, there is provided an image forming method, comprising:

(a) arranging, in a developing region, an electrostatic latent image carrier carrying an electrostatic latent image and a toner carrier for carrying a magnetic toner on the surface thereof, such that a gap of a predetermined size is left between the electrostatic latent image carrier and the toner carrier;

(b) feeding the magnetic toner to the toner carrier while regulating the thickness of the toner layer formed on the toner carrier to a value smaller than the size of the gap and conveying the toner to the developing region by the toner carrier, the toner comprising a binding resin and a magnetic iron oxide, the magnetic toner having a particle size distribution in which 12% or more by number of magnetic toner particles are 5 μm or smaller and 33% or less by number of are magnetic toner particles of 8 to 12.7 μm and in which magnetic toner particles not smaller than 16 μm exist in an amount not greater than 2.0% in terms of volume, with the volume mean particle size of the magnetic toner particles ranging from 4 to 10 μm, the binding resin having an overall acid value (A) of 2 to 100 mgKOH/g as measured through hydrolysis of acid anhydride groups in the binding resin and a total acid value (B) derived from the acid anhydrides below 6 mgKOH/g, the ratio {(B)/(A)} between the acid numbers being not greater than 60 (%); and (c) applying a bias voltage composed of a D.C. bias voltage component and an asymmetric A.C. bias component between the toner carrier and the electrostatic latent image carrier so as to form an A.C. bias electric field having a developing voltage component and a reverse-development voltage component, the developing voltage component being equal to or greater than the reverse-development voltage component and a duration smaller than that of the reverse-development voltage component, so as to cause the magnetic toner to move from the toner carrier to the electrostatic latent image carrier, thereby developing the electrostatic latent image on the electrostatic latent image carrier.

DESCRIPTION OF THE PREFERRED EMBODIMENTS

Figure 1:
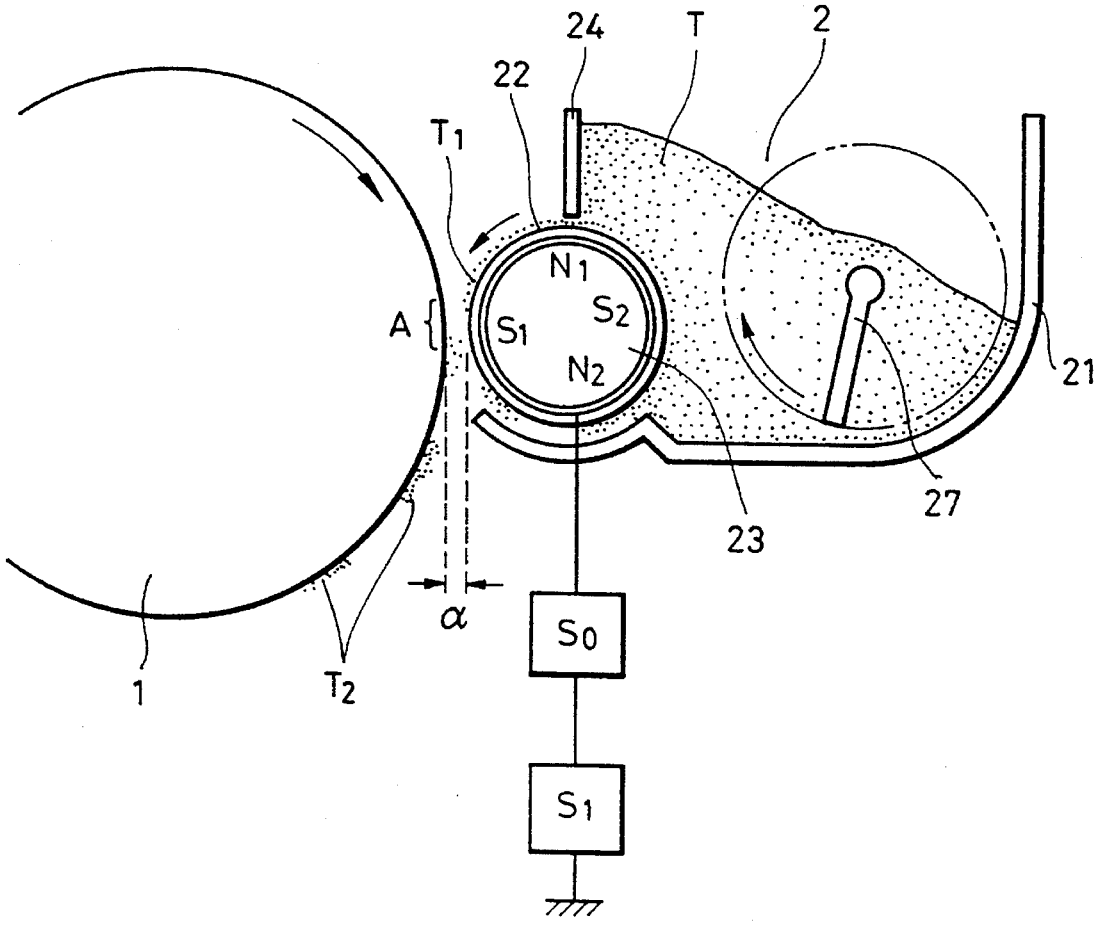
FIG. 1 is a schematic illustration of the construction of a developing device suitable for use in carrying out an image forming method in accordance with the present invention.

In order to investigate the correlation between toner particle size and developing characteristic under a developing bias voltage, an experiment was conducted in which the behavior of a magnetic toner having toner particles was observed in a gap between a toner carrier and a latent image carrier under application of developing voltage pulses. The toner used in this experiment had particle sizes distributed within a range of 0.5 to 30 μm and the gap between the toner carrier and the the latent image carrier was set to about 250 μm. The voltage level of the developing voltage pulses was set constantly to about 1000 V.

In the experiment, latent images were developed with varying width of the developing voltage pulses while the surface potential of the latent image carrier was held constant, and sizes of the toner particles participating in the development were measured to examine the relationship between the width of the developing voltage pulses and the sizes of the developing toner particles. The proportion of magnetic toner particles of 8 μor smaller, more specifically 5 μm or smaller, was large when the pulse width was 200 sec or smaller. Proportion of the magnetic toner particles of 5 μm or smaller increased as the pulse width was further reduced. This demonstrated that the smaller the magnetic toner particle size, the shorter the time required for the toner particles to reach the latent image carrier.

It is therefore understood that magnetic toner particles having smaller particle sizes can be selectively and preferentially attracted by the latent image carrier by applying a developing bias voltage such that the voltage produces a higher level of developing electric field which exists for a shorter time.

Conversely, application of the reverse-development or peeling bias voltage is conducted such that the level of the peeling voltage is set to a comparatively low level, which lasts for a comparatively long time. This ensures that (i) comparatively large magnetic toner particles which could not reach the latent image carrier during application of the developing bias voltage return to the toner carrier and (ii) that magnetic toner particles carrying a small amount of charge which also fail to reach the latent image carrier due to unduly low moving velocity also return to the toner carrier. Magnetic toner particles having small particle sizes, which have reached the latent image carrier and have deposited on the image region are not substantially peeled off during application of the reverse-development bias voltage, because the electrostatic attracting force is large and because the level of the reverse-development bias voltage is low as described above.

In contrast, any magnetic toner particles which are weakly charged, which have been deposited on the non-image region on the latent image carrier due to, for example, scattering and which cause generation of fog, are attracted again to the toner carrier by application of the reverse-development or peeling bias voltage because the electrostatic attracting force is small in this case. Accordingly, generation of fog is prevented most effectively.

According to the invention, therefore, it is possible to obtain a good toner image of minute gradation with high density without the presence of fog, by virtue of the developing method which employs a specific pattern of application of developing bias voltage.

The invention will be more fully described with reference to the accompanying drawings.

Referring to FIG. 1, a recording apparatus has a latent image carrier 1 which may be a rotary drum type photosensitive member used in electrophotography, a rotary drum type insulating member used in electrostatic recording process, a photosensitive paper used in electro-facsimile process or an electrostatic recording paper used in direct-type electrostatic recording method. The latent image carrier 1 is adapted to be rotated in the direction of the arrow so that an electrostatic latent image is formed on the surface of the latent image carrier 1 by a suitable latent image forming device or means which is not shown.

The apparatus also has a developing device 2 which includes a toner container 21 (referred to also as "toner hopper") containing a magnetic toner and a rotary cylindrical member 22 which serves as a toner carrier (referred to also as a developing sleeve). The toner carrier 22 rotates in the counterclockwise direction indicated by the arrow and also accommodates a magnetic flux generating means 23 such as a magnetic roller.

The trailing portion of the rotatable developing sleeve 22 as viewed in FIG. 1 extends into the hopper 21 while the leading portion of the same protrudes beyond the exterior of the hopper. The developing sleeve 22 is supported by bearings for rotation in the direction of the arrow. A doctor blade 24 serving as a toner layer regulating member is disposed with its lower end disposed in the close proximity of the surface of the toner sleeve 22. Numeral 27 designates a stirring member disposed inside the hopper 21.

The axis of the sleeve 22 extends substantially parallel to the generating line of the latent image carrier 1. Sleeve 22 is opposed to the surface of the latent image carrier 1 leaving a slight gap a therebetween.

The peripheral speed of the latent image carrier 1 is substantially equal to or slightly smaller than that of the sleeve 22. An A.C. bias voltage application means $S_0$ and a D.C. bias voltage application means $S_1$ are provided to apply a composite bias voltage composed of A.C. and D.C. voltage components superposed on each other across the gap between the latent image carrier 1 and the sleeve 22.

According to the invention, not only the level of the A.C. bias electric field but also the period t of application of such an electric field and the amount of friction charging on the toner carrier are controlled to achieve the aforesaid objects of the invention. More specifically, in the method of the invention,the duty ratio of the A.C. bias voltage is controlled such that the level of the developing bias electric field is elevated and the duration of the same is shortened, while the level of the reverse-development or peeling electric field is lowered and the duration of the same is prolonged, without varying the frequency of the A.C. bias voltage.

In this application, the term "developing bias electric field" or "developing bias voltage component" is used to mean an electric field component or voltage component of a polarity which is opposite to the latent image potential with respect to the potential of the toner carrier, i.e., a component of the same polarity as the toner. To the contrary, the term "reverse-development bias component" or "peeling bias component" means the component of electric field of bias voltage of the same polarity as the potential of the latent image on the latent image carrier with respect to the potential of the toner carrier.

Figure 3:
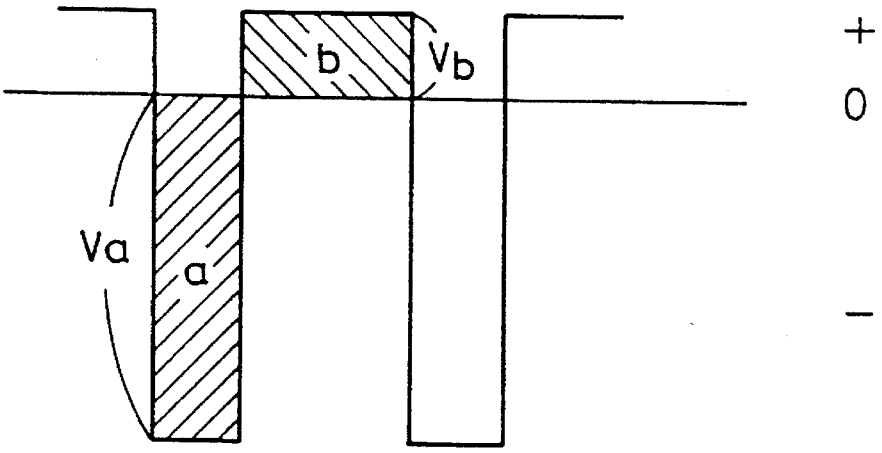
FIG. 3 is an illustration of bias voltage components.

For instance, in an asymmetric bias voltage shown in FIG. 3 which is applied when a toner of negative polarity is used to develop a latent image of positive polarity, the portion a is the developing bias component which is negative with respect to the potential of the toner carrier represented by zero, while the portion b is the reverse-development or peeling bias component which is positive with respect to the potential of the toner carrier. The levels of the developing bias component and the reverse-voltage component are respectively represented in terms of absolute values Va and Vb, respectively.

The phrase "duty ratio" of the A.C. bias electric field as employed herein is defined as follows:

$$\text{Duty Ratio}=\{t_a/(t_a+t_b)\}\times 100\ (\%)$$

where, $t_a$ represents the duration of the developing bias voltage component a which serves to bias the toner towards the latent image carrier, while $t_b$ represents the duration of the reverse-development bias component b which serves to "peel" the toner from the latent image carrier, in each cycle of the bias voltage or electric field in which the polarity changes alternatingly.

As previously explained, about half of the developing sleeve 22 which is on the right-hand or trailing side as viewed in FIG. 1 is contained in the hopper 21 in contact with the toner in the hopper 21. The toner particles in the vicinity of the surface of the developing sleeve are attracted to and held on the surface of the developing sleeve 22 by magnetic force produced by the magnetic flux generating means 23 inside the developing sleeve and/or by electrostatic attracting force. As the developing sleeve 22 rotates, the magnetic toner on the surface of the developing sleeve is made uniform as it passes through the region where the doctor blade 24 is located, whereby a toner layer $T_1$ having a small and uniform thickness is formed on the surface of the developing sleeve 22. The magnetic toner is charged mainly by frictional force between the surface of the developing sleeve 22 and the magnetic toner held within the hopper 21 in the vicinity of the sleeve surface as the sleeve is rotated. The thin layer of magnetic toner thus formed on the surface of the developing sleeve 22 is brought into the developing region (A) where the gap, between the latent image carrier 1 and the developing sleeve 22 is smallest, as a result of the rotation of the developing sleeve 22. In the developing region A, the magnetic toner particles forming the thin toner layer on the surface of the developing sleeve 22 are propelled through the air by the effect of the composite electric field generated by the composite bias voltage having the D.C. component and the A.C. component superposed on each other and applied between the latent image carrier 1 and the developing sleeve 22 so as to reciprocate between the surface of the latent image carrier 1 and the surface of the developing sleeve 22 within the developing region A. Finally, magnetic toner particles on the developing sleeve 22 are selectively attracted by and deposited onto the surface of the latent image carrier 1 in accordance with the potential pattern of the latent image, whereby a toner image $T_2$ is progressively formed on the surface of the latent image carrier 1.

The portion of the surface of the developing sleeve which has passed through the developing region A and from which toner particles have been selectively attracted is moved again into the hopper 21 in accordance with the rotation of the developing sleeve 22. Accordingly, this portion of the developing sleeve surface is supplied again with the magnetic toner. Thus,a new portion of the toner layer $T_1$ formed on the surface of the developing sleeve 22 is brought into the developing region A so as to develop a new portion of the latent image. This operation is repeated to fully develop the latent image.

The described developing method utilizes a monocomponent developing agent and is carried out in a non-contact manner. One of the problems encountered with this type of developing method is that transfer of the magnetic toner particles in the developing sleeve 22 to the latent image carrier 1 tends to be reduced due to an excessively strong attractive force which is exerted between the surface of the developing sleeve and the magnetic toner particles in the vicinity thereof and which acts to resist the movement of the toner particles towards the latent image carrier. The frictional contact between the rotating developing sleeve and the magnetic toner is continued during rotation of the developing sleeve, so that the charge applied to the magnetic toner is progressively built up to a large value, with the result that the electrostatic force (Coulomb force) is increased correspondingly. As a consequence, energy utilized for causing the magnetic toner particles to be conveyed towards the latent image carrier 1 is reduced by the force necessary to overcome the electrostatic force so as to allow these particles to stagnate around the sleeve. Such stagnant magnetic toner particles impair frictional charging of other portions of the toner and reduces their capability to develop. This problem is noticeable particularly when the humidity of the ambient air is low and when the development cycle has been repeated many times. An undesirable effect known as "toner carrier memory" also is caused by the same charge build-up.

The biasing force f which is generated by the A.C. bias voltage and which causes the magnetic toner particles to be conveyed from the sleeve onto the latent image carrier 1 must be determined such that an acceleration $\alpha$ is imparted to the particles which is large enough to enable the magnetic toner particles to reach the latent image surface. The force f is given by $f=m\cdot\alpha$, where m represents the mass of each toner particle. By representing (i) the amount of charge on the toner particle by "q", (ii) the size of the gap between the sleeve surface and the latent image carrier surface by "d" and (iii) the alternating bias electric field by "E", the force f is approximated as $f=E\cdot q(\epsilon\epsilon_0 q^2/d^2)$. Thus, the force required for the magnetic toner particles to reach the latent image carrier surface is determined by the balance between the electrostatic force which attracts the magnetic toner particles towards the developing sleeve and the force produced by the electric field which acts to drive the magnetic toner particles towards the latent image carrier surface.

Fine toner particles of 5 μm or less in size tend to gather near the developing sleeve. Conveying of such fine magnetic toner particles can be enhanced by an elevation of level of the developing electric field component. A mere elevation of the electric field level, however, causes the toner particles to be conveyed towards the latent image regardless of the pattern of the latent image. This tendency is noticeable particularly in the case of fine toner particles of 5 μm or less in size and leads to the problem of fogging. It is true that fogging can be avoided by applying the reverse-development bias voltage component of an elevated level, but application of a large alternating bias electric field between the latent image carrier 1 and the developing sleeve 22 tends to cause a direct electrical discharge between the latent image carrier 1 and the developing sleeve 22, with the result that the image is disturbed seriously.

Any increase in the level of the reverse-development bias voltage component also causes toner particles to be peeled not only from the non-image area but also from the image area carrying the latent image pattern. As a consequence, magnetic toner particles of 8 to 12.7 μm in particle size, which exhibit comparatively small mirroring force to the latent image carrier, are removed from the image area on the latent image carrier so as to cause various undesirable effects, such as disturbance of the developed image, impairment of gradation and line-image reproducibility, whiting of solid image, and so forth.

It is therefore important not to significantly increase the A.C. bias electric field and to maintain the reverse-development bias voltage component sufficiently low, thereby enabling the toner particles near the sleeve to be conveyed and to reciprocate between the sleeve and the image carrier.

The described method effectively causes reciprocative conveyence of the fine toner particles of 5 μm or smaller which are essential for improving the quality of toner image on the sleeve, without allowing such fine toner particles to stagnate on the sleeve, by suitably strengthening the developing bias electric field component. Consequently, reduction in the image density and generation of toner carrier memory are appreciably suppressed.

Figure 4:
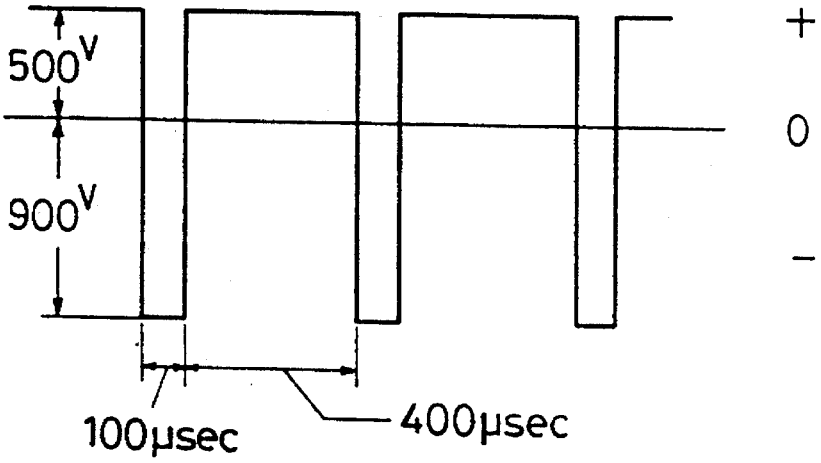
FIGS. 4 to 7 are schematic illustrations of asymmetrical alternating bias voltages employed in the present invention.

Surplus toner particles depositing to a non-image area can be pulled off the latent image carrier so as to prevent fogging, because the developing electric field component lasts a relatively long time, although the level of the reverse-development bias electric component is maintained at a low level. On the other hand, the toner particles of 8 to 12.7 μm which are essential for attaining high image density are not peeled off the image area on the latent image carrier because the level of the reverse-development bias electric component is maintained at a low level. FIG. 4 shows, by way of example, the waveform of an A.C. bias voltage used in the method of the invention.

Thus, in the method of the present invention, the effective value of the force for peeling magnetic toner particles from the non-image area is kept constant despite the reduction in the level of the reverse-development bias electric field, because the duration of this component is prolonged to compensate for the reduction in the level. In addition, application of the reverse-development bias electric field of such a reduced level does not disturb the pattern of the toner image formed on the latent image pattern. It is therefore possible to obtain a good image with distinctive gradation.

The developing sleeve used in the invention has a high ability to electrostatically charge magnetic toner particles through frictional contact and can charge such particles with a high degree of uniformity. That, in cooperation with the application of the specific developing alternating electric field of the invention, provides superior developing performance so as to ensure production of an image of a high density without any fog, while improving gradation, resolution and thin-line image reproducibility.

In the image forming method of the present invention, fine magnetic toner particles of 5 μm or smaller are efficiently consumed so as to contribute to the improvement in the image quality. These fine magnetic toner particles, when used in the method of the invention, do not cause reduction in the image density and toner carrier memory attributable to adhering to the surface of the developing sleeve even when a later-mentioned specific sleeve in accordance with the invention is used as the developing sleeve. This advantage also is obtained with medium-size magnetic toner particles of 8 to 12.7 μm. Consequently, the latent image can be satisfactorily developed with the fine and medium-size magnetic toner particles by the application of the developing bias voltage component. In addition, undesirable separation or peeling of these medium-size magnetic toner particles due to application of reverse-development bias voltage component is suppressed so as to suppress generation of image defects such as whiting of solid images and disturbance of line images.

In the image forming method of the present invention, magnetic toner particles being conveyed from the toner carrier towards the latent image carrier form magnetic brushes which rub the latent image carrier at their free ends. Toner particles in the portion of the brush near the free end of the brush, as well as toner particles carrying a large quantity of charge and toner particles which are small in size, are preferentially deposited onto the latent image carrier due to mirroring force, thereby developing the latent image into a visible image. On the other hand, toner particles in the base end portion of the brush and toner particles which have only small amount of charges are attracted again towards the toner carrier by the effect of the reverse-development bias voltage. These toner particles, moving back to the toner carrier, tend to break the brush, so as to suppress undesirable effects of the brush such as dragging or scattering of the magnetic toner particles. These advantages are remarkable particularly in the image forming method of the invention in which a developing sleeve having a surface of a specific nature which will be explained later is used in combination with a magnetic toner having a specific particle size distribution so as to form small magnetic brushes of toner particles with a high degree of uniformity. The magnetic toner is successively supplied to the latent image under the influence of the specific developing bias voltage component so as to prevent any insufficiency of deposition of the toner to the image area on the latent image carrier.

According to the image forming method of the present invention, the developing bias electric field component is of considerable strength so that toner particles having a large amount of charge are also attracted even from a region near the surface of the developing sleeve so as to participate in the development. Consequently, toner particles having a large amount of charge can be satisfactorily deposited by electrostatic attraction even to weak portions of the image pattern to obtain an appreciable edge stressing effect to enable the image to be developed with high resolution. Furthermore, fine magnetic toner particles of 5 μm or smaller, which are components effective for attaining high image quality, can be efficiently utilized to offer a remarkable improvement in the image quality.

The developing process employed in the image forming method of the invention maybe conducted with the gap between the developing sleeve 22 and the latent image carrier 1 set between 0.1 mm and 0.5 mm. This gap is set to 0.3 mm in the Examples which will be described later. This relatively wide range of possible gap sizes with a greater gap between the developing sleeve 22 and the latent image carrier 1 than in known developing system is made possible by use of a developing bias voltage of a higher level.

Images of satisfactory quality are obtainable when the absolute value of the A.C. bias voltage is 1.0 KV or higher. Considering leakage of charges to the latent image holder, the absolute value of the A. C. bias voltage is preferably not lower than 1.0 KV, but not less than 2.0 KV. Obviously, however, the extent of the leakage varies according to the size of the gap between the developing sleeve 22 and the latent image holder 1.

The frequency of the A.C. bias voltage preferably ranges from 1.0 KHz to 5.0 KHz. Frequencies lower than 1.0 KHz improve gradation, but make it difficult to eliminate fogging of non-image areas. This is attributable to the fact that the frequency of reciprocative movement of the toner particles is low, so that the effect of the developing bias electric field component becomes more dominant and directs the toner particles too strongly onto the latent image carrier. The effect of the reverse-development bias electric field component becomes less dominant and fails to peel the toner particles from the non-image area on the latent image carrier.

On the other hand, frequencies exceeding 5.0 KHz impede development because the reverse-development bias electric field is applied before the toner particles, driven by the developing bias electric field component, are sufficiently directed onto the latent image carrier. In other words, the movement of the toner particles cannot respond to such a high. frequency of change of polarity of the electric field.

Excellent image forming performance was obtained when the frequency of the A. C. bias electric field was within the range of 1.5 KHz to 3 KHz.

The A.C. bias electric field employed in the present invention has a waveform such that the duty ratio, as defined before, is less than 50% and preferably not smaller than 10% but not greater than 40%. A waveform of the A.C. bias electric field having a duty ratio exceeding 40% tends to make the aforementioned drawbacks noticeable. On the other hand, when the duty ratio is below 10%, developing performance is impaired because of the insufficiency of the energy for urging the toner particles towards the latent image carrier. More preferably, the duty ratio is not less than 15% and not less than 35%.

The waveform of the A. C. bias voltage or electric field may be rectangular, sine, saw-tooth or triangular.

An experiment was conducted in which electrostatic latent images were developed by a magnetic toner having the composition specified by the invention and particle sizes distributed over a range of 0.5 to 30 μm. In this experiment, the surface potential of the photosensitive member was varied to create latent images of various potential contrasts including (a) images of large potential contrast which attract large quantities of toner particles, (b) halftone image having medium levels of potential contrast and (c) images of small potential contrast which attract only small quantities of toner particles. Toner particles attracted by the latent images on the photosensitive members were collected for measurement of the particle size distributions. The results showed that a large portion of the magnetic toner particles participating in development constituted particles of 8 μm or smaller, particularly particles of 5 μm or smaller. It should be understood that a latent image can be developed with high degree of fidelity without allowing the toner to spread out of the pattern of the latent image, to minimize reproducibility, when magnetic toner particles of 5 μm or smaller are smoothly supplied to the latent image.

One of the requirements for the magnetic toner used in the method of the present invention is that the magnetic toner particles of 5 μm or smaller occupy 12% or more of the whole toner in terms of the number of particles. Hitherto, it has been difficult to control the amount of charge on magnetic toner particles of 5 μm or smaller. Accordingly, such fine magnetic toners were often charged excessively so as to cause various undesirable effects. For instance, such excessively charged fine magnetic toner particles tended to stick to the sleeve surface due to unduly strong mirroring effect so as to impede frictional charging of other magnetic toner particles. That resulted in insufficient charging of the magnetic toner particles of greater sizes and caused consequent defects in developed images, such as roughening and reduction of density. For these reasons, it has been a commonly understood that fine magnetic toners of 5 μm or smaller should be excluded from developers.

The present invention provided the contrary, however, to the above-mentioned common understanding. Namely, the inventors found that magnetic toner particles of 5 μm or less are essential components for obtaining developed images of high quality.

It should be appreciated that the present invention can cause an efficient flight of fine toner particles having particle sizes of 5 μm or smaller so that sticking of such fine toner particles to the sleeve surface, which has been one of the problems of the prior art, can be effectively avoided.

Another critical feature of the method of the invention is that the magnetic toner used in the method contains not more than 33% of toner particles of particle sizes ranging between 8 and 12.7 μm in terms of the number of the particles. This feature is closely related to the need for the presence of fine magnetic toner particles of 5 μm or smaller, as stated before. Fine toner particles of 5 μm or smaller have the ability to exactly cover a latent image so as to develop the image with a high degree of fidelity. In general, however, a solid latent image itself has a stronger electric field intensity at its edge portion than its central or mid portions. Consequently, the magnetic toner particles tend to be deposited more heavily on the edge portion of the latent image than the central portion of the image, which reduces the image density in the central region of the solid image. This tendency is noticeable particularly in the case of magnetic toner particles of 5 μm or smaller. The present inventors have found that this problem can be overcome and a clear solid image of high density can be obtained when the magnetic toner used in the development contains not more than 33% of toner particles of particle sizes ranging between 8 and 12.7 μm in terms of number of the particles, in addition to the prescribed amount of fine magnetic toner particles of 5 μm or less. This advantageous effect is attributable to the fact that for toner particles of 8 of 12.7 μm, charges thereon are moderately controlled. Therefore, such particles tend to be attracted by the central region of solid latent image where the electric field intensity is small rather than by the edge portion of the image. Therefore, the toner particles are evenly distributed over the area of the solid latent image to improve image density, resolution and gradation, thus enabling production of an image having a sharp contrast.

According to this invention, the content of the magnetic toner particles of 5 μm or less preferably ranges from 12 to 60% in terms of number of particles. When the volume-mean particle size is from 4 to 10 μm, preferably from 4 to 9 μm, the magnetic toner used in the method of the present invention preferably meets the condition of the following formula:

$$N/V=-0.04N+K$$

wherein, $4.5 \leqq K \leqq 6.5$; $12 \leqq N \leqq 60$ where, N (%) represents the content of the magnetic toner particles of 5 μm or smaller in terms of number of particles, V (%) represents the volumetric percentage of such fine magnetic toner particles and K represents a constant from 4.5 to 6.5. It has been confirmed that the image forming method of the present invention provides further improved developing characteristics when the magnetic toner used in the method has a particle size distribution which satisfies the above-mentioned condition.

Namely, the inventors have conducted a study to determine optimum particle size distribution of the magnetic toner particles of 5 μm or less. They discovered that there is a certain pattern of distribution of particle sizes which maximizes the advantageous effect produced by the present invention. When the content N of the fine magnetic toner particles is within the range of $12 \leqq N \leqq 60$, the fact that the ratio N/V is large means that the toner contains large numbers of finer magnetic toner particles. Conversely, the fact that the ratio N/V is large means that the proportion of the magnetic toner particles having sizes approximating 5 μm is large, while the proportion of finer particles is small, when considering the group of fine magnetic toner particles 5 μm or less. It has been confirmed that, when the content N of the magnetic toner particles of 5 μm or finer ranges from 12 to 60, superior thin-line reproducibility and high resolution are attainable, particularly when the ratio N/V ranges from 2.1 to 5.82 and meets the condition of the formula shown before.

The content of large magnetic toner particles of 16 μm or greater is preferably reduced and is limited to be 2.0 vol. % or less in the magnetic toner used in the present invention.

A detailed description will be given as to the nature of the magnetic toner used in the present invention.

According to the invention, the content of the magnetic toner particles of 5 μm or less in the magnetic toner is preferably not less than 12%, more preferably 12 to 60% and most preferably 17 to 50%, in terms of the number of particles. As explained before, magnetic toner particles of 5 μm or less contribute to improvement in the image quality. The contribution, however, is not appreciable when the content of such fine magnetic toner particles is below 12% in terms of the number of particles. In particular, such fine magnetic toner particles are progressively consumed so that the content of such fine magnetic toner particles is progressively decreased as the copying or printing operation is continued. As a consequence, the particle size distribution falls out of the range specified by the invention, with the result that the image quality is progressively degraded.

On the other hand, the presence of undue amount of magnetic toner particles of 5 μm or less undesirably promotes aggregation. Aggregates of toner which have much greater sizes than expected can be formed. The presence of such large aggregates of toner particles roughens the image, reduces resolution and increases the difference in the density between the edge portion and the central region of the solid latent image, allowing generation of a toner image in which the solid area is somewhat whitened.

The present inventors found that fine magnetic toner particles of 5 μm or smaller are essential for stabilizing the volume-mean particle size of the magnetic toner on the sleeve during continuous development.

Namely, since fine magnetic toner particles of 5 μm or less are consumed at a greater rate than particles of other sizes, the volume mean particle size of the magnetic toner particles on the sleeve is progressively increased during long continuous developing operation, if the initial content of such fine magnetic toner particles is small. As a result, the M/S ratio ($mg/cm^2$) of the toner layer on the sleeve is increased tending to make it difficult to form a uniform toner layer on the sleeve.

The content of the magnetic toner particles of a size between 8 and 12.7 μm is preferably not greater than 33%, more preferably 1 to 33%, in terms of number of the particles. Presence of magnetic toner particles in excess of 33% causes not only degradation of image quality, but also increases consumption of the toner due to excessive deposition of the toner to the latent image. On the other hand, production of a developed image with sufficiently high density often fails when the content of the magnetic toner particles of a size between 8 and 12.7 μm is less than 1% in terms of number of the particles.

As stated before, a relationship expressed by $N/V=-0.04N+K$ exists between the content N (%) of the magnetic toner particles of 5 μm or less in terms of number of particles and the volumetric percentage V (%) of the same. The constant K has a positive value represented by $4.5 \leqq K \leqq 6.5$, preferably by $4.5 \leqq K \leqq 6.0$. As described before, the content N meets the condition of $12 \leqq N \leqq 60$ and, when this condition is met, the volume-mean particle size is 4 to 10 μm.

When the value of the constant K is below 4.5, the content of magnetic toner particles of sizes below 5.0 μm is too small to provide acceptable levels of image density, resolution and sharpness. It is to be understood that the presence of a suitable amount of such finer magnetic toner particles, which hitherto has been considered as being unnecessary, enables compacting of the toner particles so as to contribute to generation of uniform images having no local coarseness. In particular, such finer magnetic toner particles accurately and uniformly attach to the thin-line latent image and profile edges of two-dimentional latent images so as to enhance the sharpness of the developed image. This advantageous effect, however, is not appreciable when the value of the constant K is below 4.5. Furthermore, preparation of magnetic toner is not easy when the value of the constant K is below 4.5, in terms of strictness of the screening or classifying conditions, and is disadvantageous in terms of yield and cost.

Values of K exceeding 6.5 denotes the presence of excessively large amounts of finer magnetic toner particles. When a toner having such large content of finer particles is used for repeated development, the particle size distribution is soon changed which promotes aggregation of the toner and impedes frictional charging and contributes to imperfect cleaning and the generation of fog.

The content of magnetic toner particles of 16 μm or greater is preferably not more than 2.0 vol %, more preferably not more than 1.0 vol % and most preferably not more than 0.5 vol %. The presence of such large magnetic toner particles in excess of 2.0 vol % impairs reproduction of thin-line images. In addition, the delicate state of contact between the photosensitive member and the transfer paper across the toner layer is adversely affected by such large magnetic toner particles projecting from the surface of the toner layer, with the result that the image transfer condition is so impaired that it degrades the quality of the transferred image.

Furthermore, in the image forming method of the present invention, particles of magnetic toner greater than 16 μm cannot transfer well unless they are strongly charged. Consequently, such large magnetic toner particles tend to stagnate on the toner carrier so as to cause a rapid change in the particle size distribution of the toner on the sleeve. Such stagnation also hampers frictional charging of the toner particles of smaller sizes so as to impair developing performance, and disturbs the magnetic brushes to cause a degradation in the quality of the developed image.

In contrast to the magnetic toner particles of 5 μm or smaller, magnetic toner particles of 16 μm or greater are not so rapidly consumed during a long continuous developing operation. When the initial content of such large magnetic toner particles exceeds 2.0 vol %, therefore, the volume mean particle size of the toner on the sleeve is soon increased to undesirably increase the M/S ratio of the toner in the sleeve.

The magnetic toner suitably used in the method of the present invention has a volume-mean particle size ranging from 4 to 10 μm, preferably from 4 to 9 μm. This requirement is related to the requirements described hereinbefore. A volume-mean particle size less than 4 μm tends to cause a reduction in the image density due to insufficient deposition of the toner to the transfer paper, particularly in the cases of graphic images in which areas occupied by the images are large. This is considered to be attributable to the same reason as that described before in connection with reduction of density in the central region of a solid latent image with respect to edges of the image. Conversely, a volume-mean particle size exceeding 10 μm does not provide an acceptable level of resolution and is liable to progressively degrade the image quality during long use, due to a change in the particle size distribution, although the image quality is not so bad at the beginning of the continuous copying operation.

The magnetic toner having a particle size distribution specified by the present invention can reproduce latent images formed on a photosensitive member with a high degree of fidelity even when the latent image is a thin line image. The toner reproduces with high fidelity halftone or dot images as well, thus offering superior gradation and resolution of the developed image. In addition, this superior effect of the toner can be maintained for a long time so that the image quality is not substantially degraded even after a long continuous copying or printing operation. Furthermore, the magnetic toner used in the method of the present invention can develop latent images of high potential contrast with reduced consumption of the toner particles compared to known toners. Thus, the toner in accordance with the present invention provides various advantages not only from the viewpoint of performance, but also from the viewpoint of economy and the size of the image forming apparatus.

The above-described superior effects are enhanced when the magnetic toner as specified by the invention is used under the developing conditions specified herein.

The particle size distribution of the toner can be measured by various measuring methods including a Coulter Counter.

More specifically, the measurement of the particle size distribution was conducted by using a measuring system having a Coulter Counter TA-II (produced by Coulter Co., Ltd.) and a personal computer CX-1 (produced by Canon Inc.) connected to the Coulter Counter through an interface (produced by Nikkaki Co.,Ltd.) for outputting particle size distribution in terms of numbers of particles and particle size distribution in terms of volume. A NaCl aqueous solution of about 1% concentration was prepared as an electrolyte, using primary sodium chloride. For instance, ISOTON R-II (produced by Coulter Scientific Japan) can be used suitably as the electrolyte. The measurement is conducted by the following process. About 0.1 to 5 ml of surfactant, preferably an alkylbenzene sulfonate, is added as a dispersion agent in 100 to 150 ml of the above-mentioned electrolytic aqueous solution, and then the specimen is added in an amount of 2 to 20 mg into the solution. The resulting suspension is treated 1 to 3 minutes by a supersonic disperser which disperses the suspension. The particle size distribution of the resulting dispersion is measured by the above-mentioned Coulter Counter TA-II which measures the particle size distribution of particles having sizes ranging between 2 and 40 μm on the basis of the number of particles. The factors of the particle size distribution as specified by the invention are then obtained from the results of the measurement.

The binding resin contained in the magnetic toner used in the method of the present invention has a certain acid number in order to improve the fixing performance. More specifically, the total acid number (A) measured through a hydrolysis of acid anhydride groups of the binding resin should be 2 to 100 mgKOH/g, preferably 5 to 70 mgKOH/g and more preferably 5 to 50 mgKOH/g.

Fixing cannot be conducted satisfactorily when the total acid number (A) is below 2 mgKOH/g, while any total acid number (A) exceeding 100 mgKOH/g makes it difficult to control the chargeability of the magnetic toner.

Carboxyl groups and acid anhydride groups are suitably used as components for providing the required acid number. These functional groups, however, significantly affect the chargeability of the magnetic toner. For instance, carboxyl groups existing in polymer chains produce a weak negative charging ability. However, when the content of the carboxyl groups is increased, the hydrophilic nature of the resin is increased to allow discharge of electrostatic charges to the water component in the ambient air. This tendency is enhanced as the amount of the carboxyl groups is increased.

Acid anhydride groups also possess ability to impart negative charges, but show substantially no or very small capability for discharging electrostatic charges. A binding resin containing such functional groups exhibit negative charging characteristics, so that it is preferably used in a magnetic toner having negative chargeability. Such a binding resin, however, can be used in a magnetic toner having positive chargeability provided that a charge control agent is suitably selected. Such functional groups can be caused to discharge positive electrostatic charges provided that the negative chargeability of the functional groups is overcome by the positive charging potential of the positive charge control agent.

The content or proportion of the functional groups, therefore, is one of the critical factors for stabilizing the charging characteristic of the magnetic toner. The carboxyl groups serve not only to release charges but also to improve chargeability.

On the other hand, acid anhydride groups contribute only to improving chargeability. The discharge of electrostatic charges becomes substantial in the presence of abundant carboxyl groups. Accordingly, the charge of the magnetic toner tends to become insufficient resulting in an insufficiency of the image density. This tendency to discharge a stored charge becomes greater as the humidity of the ambient air increases.

On the other hand, an abundance of acid anhydride groups causes excessive charging of the magnetic toner, which tends to cause generation of fog. This tendency is serious particularly when the humidity is low and leads to a reduction in the image density.

It is therefore possible to attain a good balance between release of charges and provision of appropriate chargeability by suitably determining the contents of these two types of functional groups, thus making it possible to stabilize the chargeability of the magnetic toner, thereby minimizing variation of the chargeability against any change in the environmental conditions.

Thus, in the present invention, chargeability of the magnetic toner is primarily derived from the presence of acid anhydride groups, while release of electrostatic charges is effected by the carboxyl groups, whereby excessive charging of the magnetic toner is prevented by balancing such groups appropriately.

The binding resin in the magnetic toner used in the method of the present invention should further meet the following requirements.

The total acid number (B) derived from the acid anhydride should be 6 mgKOH/g or less. Any total acid number (B) exceeding 6 mgKOH/g tends to cause an excessive charging of the magnetic toner, thereby causing a reduction in the image density and fogging in the developed image particularly when the humidity of the ambient air is low.

Thus, the total acid number (B) preferably meets the condition of 0.1 mgKOH/g$\leqq$(B)$\leqq$6mgKOH/g, more preferably 0.5 mgKOH/g$\leqq$(B)$\leqq$5.5 mgKOH/g.

It is also preferred that the total acid number (B) derived from the acid anhydride groups amounts to 60% or less, more preferably 50% or less and most preferably 40% or less of the total acid number (A), i.e., (B)/(A)<0.6, of the whole binding resin. When the total acid number (B) exceeds 60% of the total acid number (A), the balance between the ability to impart chargeability and the ability to release charges is lost. Therefore, surplus chargeability in the toner occurs, which tends to cause excessive charging of the magnetic toner.

More specifically, the value expressed by (B/A)×100 preferably ranges from 1 to 60 (%), more preferably from 2 to 50 (%) and most preferably from 3 to 40 (%).

The binding resin containing acid anhydride groups exhibits a peak of infrared spectrum absorption in the region between about 1750 cm–1 and 1850 $cm^{-1}$ due to the presence of such groups. A sufficiently high stability of charging characteristic of the magnetic toner can be obtained when the acid anhydride groups exist in an amount which exhibits such a peak in infrared spectral absorption analysis.

Absorption by carbonyl groups of an acid anhydride appears in infrared spectrum absorption at the higher-frequency side compared to an ester or an acid. The presence of acid anhydride groups, therefore, can be definitely confirmed.

The binding resin usable in the magnetic toner employed by the method of the invention can be prepared from vinyl-type polymers having one of the following monomers.

For instance, vinyl-type monomers which provide the binding resin with acid number are: an unsaturated dibasic acid such as maleic acid, citraconic acid, itaconic acid, alkenylsuccinic acid, fumaric acid or mesaconic acid; an unsaturated dibasic acid anhydride such as maleic acid anhydride, citraconic acid anhydride, itaconic acid anhydride or alkenylsuccinic acid anhydride; an unsaturated dibasic acid half ester, such as methyl maleic acid half ester, ethyl maleic acid half ester, butyl maleic acid half ester, methyl citraconic acid half ester, ethyl citraconic acid half ester, butyl citraconic acid half ester, methyl itaconic acid half ester, methyl alkenylsuccinic acid half ester, methyl fumaric acid half ester or methyl mesaconic acid half ester; and an unsaturated dibasic acid ester such as dimethyl furmarate.

It is also possible to use an α-, β- unsaturated acid such as an acrylic acid, methacrylic acid, crotonic acid or cinnamic acid; α-, β- unsaturated acid anhydride such as crotonic acid anhydride or succinic acid anhydride, as well as an anhydride of such an α-, β- unsaturated acid and a low-grade aliphatic acid; alkenyl malonic acid, alkenyl glutaric acid, alkenyl adipic acid, an anhydride of such acid or a monoester thereof.

Among these monomers, monoesters of such α-, β-unsaturated dibasic acids such as maleic acid, fumaric acid and succinic acid are used most suitably as the monomer from which the binding resin in the magnetic toner used in the invention is prepared.

Examples of the comonomer of the vinyl copolymer are shown below.

Typically, comonomers suitably used are: styrene and its derivatives such as o-methylstyrene, m-methylstyrene, p-methylstyrene, p-methoxystyrene, p-phenylstyrene, p-chlorostyrene, 3, 4-dichlorostyrene, p-ethylstyrene, 2, 4-dimethylstyrene, p-n-butylstyrene, p-tert-butylstyrene, p-n-hexylstyrene, p-n-octylstyrene, p-n-nonylstyrene, p-n-decylstyrene and p-n-dedocyl styrene; ethylene unsaturated mono-olefins such as ethylene, propylene, butylene and isobutylene; unsaturated polyenes such as butadiene; vinyl halides such as vinyl chloride, vinylidene chloride, vinyl bromide and vinyl fluoride; vinyl ester acids such as vinyl acetate, vinyl propionate and vinyl benzoate; α-methylene aliphatic monocarboxylic acid esters such as methylmethacrylate, ethylmethacrylate, propylmethacrylate, n-butylmethacrylate, isobutylmethacrylate, n-octylmethacrylate, dodecylmethacrylate, 2-ethylhexylmethacrylate, stearylmethacrylate, phenylmethacrylate, dimethylaminoethylmethacrylate and diethylaminoethylmethacrylate; acrylic acid esters such as methylacrylate, ethylacrylate, n-butylacrylate, isobutylacrylate, propylacrylate, n-octylacrylate, dodecylacrylate, 2-ethylhexylacrylate, stearylacrylate, 2-chloroethylacrylate and phenylacrylate; vinyl ethers such as vinylmethyl ether, vinylethylether and vinylisobutylether; vinylketones such as vinylmethylketone, vinylhexylketone and methylisopropenylketone; N-vinyl compounds such as N-vinyl pyrrole, N-vinylcarbazole, N-vinylindole and N-vinylpyrrolidone; vinylnaphthalenes; derivatives of acrylic acids or methacrylic acids such as acrylonitrile, methacrylonitrile and acrylamide; esters of the aforementioned α, β-unsaturated acids; and diesters of dibasic acids. One of these vinyl monomers may be used alone or two or more of them may be used in combination.

Among various combinations of monomers available from the above-mentioned monomers, combinations of monomers which form styrene copolymers or styrene-acryl copolymers are used preferably.

A monomer having at least two polymerizable double bonds is used as the cross-linking monomer.

The binding resin used in the present invention may be a polymer which is cross-linked as desired by a cross-linking monomer. Examples of such cross-linking monomers are shown below.

Examples of such monomers are: aromatic divinyl compounds such as divinylbenzene and divinylnaphthalene; diacrylate compounds bonded by alkyl chains, such as ethyleneglycol diacrylate, 1, 3-butyleneglycol diacrylate, 1, 4-butanediol diacrylate, 1, 5-pentanediol acrylate, 1, 6-hexanediol diacrylate, neopentylglycol diacrylate and compounds obtained by substituting methacrylates for acrylates in such acrylate compounds; diacrylate compounds bonded by alkyl chains containing ether bonds, such as diethyleneglycol diacrylate, triethyleneglycol diacrylate, tetraethyleneglycol diacrylate, polyethyleneglycol #400 diacrylate, polyethyleneglycol #600 diacrylate, dipropyleneglycol diacrylate and compounds obtained by substituting methacrylates for acrylates in such diacrylate compounds; diacrylate compounds bonded by chains containing aromatic group and ether bond, such as polyoxyethylene (2)-2, 2-bis(4-hydroxyphenyl)propane diacrylate, polyoxyethylene(4)-2,2-bis(4-hydroxyphenyl)propane diacrylate and compounds obtained by substituting methacrylates for acrylates in such compounds; and polyester type diacrylate compounds such as MANDA (commercial name of a compound produced by Nihon Kayaku).

As the multi-function cross-linking agents, the following compounds are usable: pentaerythritol triacrylate, trimethylolethane triacrylate, trimethylolpropane triacrylate, tetramethylolmethane tetracrylate, oligoester acrylate and compounds formed by substituting methacrylate for the acrylates in such compounds; triallylcyanurate; and triallyl trimellitate.

Preferably, such a cross-linking agent can be used in an amount of 0.01 to 5 wt %, preferably 0.03 to 3 wt % with respect to 100 wt % of other monomer components.

Among these cross-linking monomers, aromatic divinyl compounds, particularly divinylbenzene, and diacrylate compounds bonded by chains containing aromatic group and ether bond are preferably used because they provide excellent toner fixing characteristics and anti-offset characteristics.

The binding resin in accordance with the invention may be formed from a homopolymer or copolymer of the vinyl monomers mentioned above. Such homopolymer or copolymer as desired may be mixed with polyester, polyurethane, an epoxy resin, polyvinylbutyral, rosin, denaturated rosin, terpene resin, phenol resin, aliphatic or alicyclic hydrocarbon resin, aromatic petro-resin, haloparaffin or paraffin wax.

Qualitative and quantitative analysis of the functional groups in the binding resin of the magnetic toner used in the method of the present invention can be done by, for example, infrared spectral absorption analysis, acid number measuring method as specified in JIS K-0070 or hydrolytic acid number measuring method (total acid number measuring method).

For instance, in the infrared spectral absorption method, the peak of absorption due to the carbonyl groups of the anhydride appears near 1780 $cm^{-1}$, thus identifying the presence of acid anhydride.

In this application, the term "peak" of infrared spectral absorption means a peak which can be clearly recognized as a peak after 16-time accumulation by an FT-IR having a resolution of 4 $cm^{-1}$. An example of the FT-IR suitably used is the FT-IR 1600, produced by Perkin Elmer Co., Ltd.

The acid number measuring method of JIS K-0070 (referred to as "JIS acid number", hereinafter) measures about 50% of the theoretical acid number of acid anhydride (acid anhydride is assumed to have an acid number as dicarboxylic acid).

On the other hand, the measurement of the total acid number (A) provides a value which is substantially equal to the theoretical value. The difference between the total acid number (A) and the JIS acid number, therefore, amounts to about 50% of the theoretical value. The acid anhydride is measured as dibasic acid. It is therefore possible to determine the total acid number (B) derived from the acid anhydride per gram by the following formula:

$$\text{Total acid number } (B) = [\text{total acid number } (A) - \textit{JIS}\text{acid number}] \times 2$$

When a vinyl copolymer composition used as the binding resin is prepared by a solution polymerization process and a suspension polymerization process using a maleic acid ester as the acid component, the total acid number (B) is determined by measuring the JIS acid number and the total acid number (A) of the vinyl copolymer formed by the solution polymerization process. Then, the amount, e.g., mol %, of acid anhydride generated during polymerization process and during removal of solvent can be calculated from the measured total acid number (B) and the composition of the vinyl monomer used in the solution polymerization process. The vinyl copolymer prepared in the solution polymerization method is dissolved in a monomer such as styrene or butylacrylate so as to adjust the monomer composition and the thus prepared monomer composition is subjected to polymerization by the suspension polymerization process. Some of the acid anhydride groups open their rings in the course of this polymerization. It is possible to calculate the amounts of dicarboxylic acid groups, acid anhydride groups and dicarboxylic monoester groups in the vinyl copolymer composition used as the binding resin, from the JIS acid value of the vinyl copolymer composition obtained through the suspension polymerization, total acid number (A), monomer composition and the amount of addition of the vinyl copolymer prepared by the solution polymerization process.

For instance, the total acid number (A) of the binding resin is determined by the following procedure.

The sample resin, 2 g in weight, is dissolved in 30 ml of dioxane to form a solution. Then, 10 ml of pyridine, 20 mg of dimethylamino pyridine and 3.5 ml of water are added to the solution. The mixture thus formed is refluxed for 4 hours while being heated and stirred. After cooling, the mixture is titrated with (1/10)N KOH.THF solution by using phenolphthalein as an indicator, whereby an acid number is determined as the total acid number (A). Under the described conditions for the measurement of the total acid number (A), acid anhydride groups are decomposed by hydrolysis into dicarbonates. Hydrolysis, however, does not occur on acrylic acid ester groups, methacrylic acid ester groups and dicarboxylic acid ester groups.

The (1/10)N KOH.THF solution used in the titration is prepared as follows. 1.5 g of KOH is dissolved in about 3 ml of water. Then, 200 ml of THF and 30 ml of water are added. The mixture thus formed is then agitated. After settling of the mixture, a small quantity of methanol is added if separation has taken place in the solution, whereas, if the solution is still in suspending state, a small quantity of water is added, thus preparing a uniform and transparent solution. The normality of the KOH.THF solution is then standardized by means of (1/10)N standard HCl solution.

The total acid number (A) of the binding resin in the toner used in the method of the invention is from 2 to 100 mgKOH/g. It is preferred that the acid number of the vinyl copolymers in the binding resin, including acid components, is less than 100 when measured by the JIS-0070 method. When this acid number is 100 or greater, densities of functional groups such as carboxyl groups and acid anhydride groups becomes too high, which makes it difficult to attain good balance of electrostatic charging. It would be possible to use a binding resin having high acid number after a dilution. Such a method, however, encounters difficulty in regard to the dispersibility of the resin.

Synthesis of the binding resin in the present invention may be conducted by using various polymerization methods such as block polymerization, solution polymerization, suspension polymerization and emulsifying polymerization. When a carboxylic acid monomer or an acid anhydride monomer is used, it is preferred to use the block polymerization method or the solution polymerization method, in view of the natures of such monomers.

The vinyl copolymer, which is one of the features of the magnetic toner used in the present invention, can be prepared by, for example, one of the following processes. For instance, a vinyl copolymer can be obtained by using monomers such as dicarboxylic acid,dicarboxylic acid anhydride and dicarboxylic acid monoester, through a block polymerization method or solution polymerization method. When the solution polymerization method is used, it is possible to partially dehydrate the dicarboxylic acid and dicarboxylic acid monoester units by suitably determining the condition of distillation for removal of the solvent. The vinyl copolymer obtained through the block polymerization or solution polymerization can be further dehydrated by being heated. It is also possible to partially esterify the acid anhydrides by using a suitable compound such as an alcohol.

Conversely, the vinyl copolymer thus obtained may be subjected to a hydrolysis so that some of the acid anhydride groups open their rings so as to be changed into dicarboxylic acid.

The vinyl copolymer which is formed from dicarboxylic acid monoester monomers through suspension polymerization or emulsifying polymerization can be dehydrated by heating. It is also possible to make the anhydrides to open their rings through hydrolysis thereby changing the anhydrides to dicarboxylic acid. It is possible to employ a process in which vinyl copolymer obtained through block polymerization or solution polymerization is dissolved in a monomer and the thus formed solution is subjected to a suspension polymerization or emulsifying polymerization so that a vinyl polymer or copolymer is obtained. According to this process, part of the acid anhydrides open their rings so that dicarboxylic acid units are obtained. In this process,another resin may be mixed in the monomer during the polymerization. In such a case, the product resin maybe changed into acid anhydride by heating. A treatment with a weak alkali aqueous solution may be effected so as to open rings of the acid anhydride. The acid anhydride also maybe esterified through a treatment with an alcohol.

Dicarboxylic acids and dicarboxylic acid anhydride monomers exhibit strong mutual polymerizing characteristic. In order to obtain a binding resin composed of vinyl copolymer having uniform dispersions of functional groups such as anhydrides and dicarboxylic acid, it is preferred to employ, for example, a process having the steps of forming a vinyl copolymer from dicarboxylic acid monoester monomers through solution polymerization, dissolving the vinyl copolymer in a monomer, and subjecting this solution to suspension polymerization thereby forming the binding resin. By suitably determining the conditions of solvent-removing distillation after the solution polymerization, it is possible to dehydrate the whole or only the dicarboxylic acid monoester of the vinyl copolymer through a dealcohol ring-closing reaction. During the suspension polymerization, the acid anhydride groups are changed into dicarboxylic acid through a hydrolytic ring-closing reaction.

Generation or extinction of acid anhydride in the polymer can be confirmed through infrared spectral absorption because presence of acid anhydride causes the spectrum to shift to a higher side as compared to the acid and ester.

The binding resin thus obtained has uniform dispersions of carboxylic groups, anhydride groups and dicarboxylic acid groups, so that it can provide superior chargeability to the magnetic toner.

The magnetic iron oxide used in the present invention, having an FeO content ranging between 25 and 30 wt %, has a high chromaticity of black color, as well as moderate level of electrical resistance, thus contributing to stabilization of chargeability of the magnetic toner. This magnetic iron oxide, therefore, can improve the image density and also to reduce fogging in the developed image.

When a magnetic iron oxide having an FeO content less than 25% is used in the magnetic toner, it is not easy to properly control the amount of charge on the magnetic toner, particularly when the magnetic toner is used in a high-speed copying machine in an atmosphere of low temperature and low humidity. This makes it difficult to prevent defects such as reduction in the image density and fogging of the image background attributable to excessive charging of the magnetic toner.

On the other hand, use of a magnetic iron oxide having an FeO content exceeding 30 wt % causes a reduction in charging of the magnetic toner particularly in humid air, tending to cause a reduction in the image density.

It is therefore possible to obtain, by employing a magnetic iron oxide having an FeO content of 25 to 30 wt % together with the binding resin described before, a magnetic toner which is never charged excessively even in air of low humidity and which can maintain a moderate level of charge amount for a long time.

Preferably, the magnetic iron oxide has a mean particle size of 0.1 to 0.5 μm, and is contained in the magnetic toner in an amount of 20 to 200 weight parts, preferably 40 to 150 weight parts per 100 weight parts of binding resin.

It has also been found that the magnetic toner thus prepared can improve the fixing characteristic, which is quite advantageous in high-speed copying machines.

The reason why the fixing characteristic is improved has not been theoretically determined yet but the inventors consider that this advantageous effect is attributable to the fact that a good balance is maintained between the release of charges and accumulation of the same at the microscopic interface of the toner particle so as to enable a uniform charging of each independent toner particle.

Figure 2:
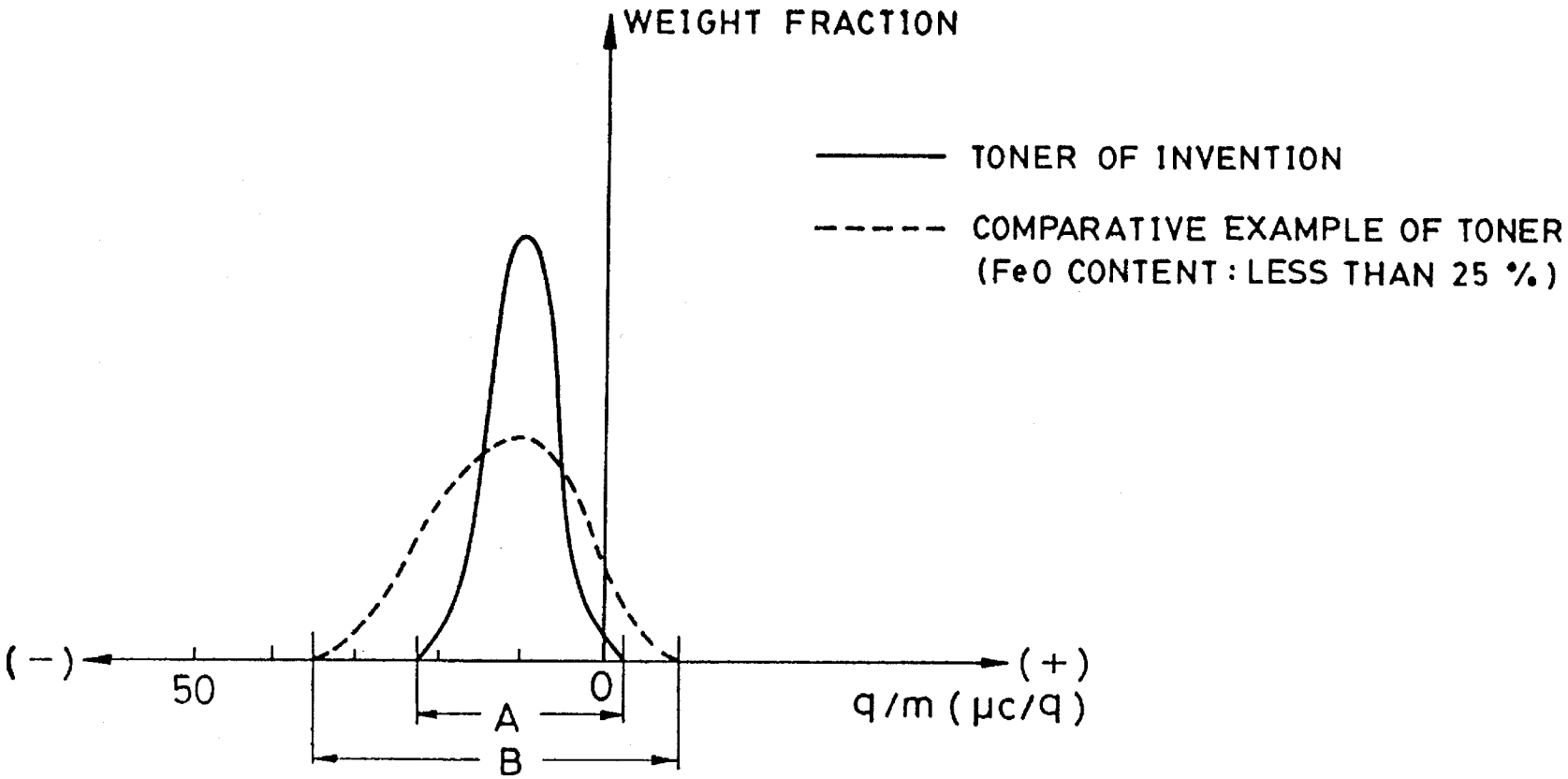
FIG. 2 is a graph showing charge amount distribution in a toner used in the method of the invention, together with the charge amount distribution of a comparative toner.

The charge amount distribution per weight of the magnetic toner used in the present invention was measured by a charge amount distribution measuring device, the E-SPANNER ANALYZER (produced by Hosokawa Micron). The charge amount distribution also was measured on a comparative toner which was prepared by the same process as the magnetic toner used in the invention except that the FeO content was less than 25 wt %. The results of the measurement are shown in FIG. 2. The charge amount per unit weight of the magnetic toner is expressed by q/m (μc/g).

In the present invention, evaluation as to whether the charge amount distribution (q/m distribution) of the magnetic toner is sharp or broad is made on the basis of the widths A and B of the curves representing the charge amounts q/m. The smaller width of the q/m curve indicates that the charge amount distribution (q/m distribution) is sharp.

Referring to FIG. 2, the distribution curve width A obtained with the magnetic toner used in the present invention is 27 (μc/g), while the distribution curve width B obtained with the comparative toner is 48 (μc/g). Thus, the magnetic toner used in the present invention exhibits a much higher sharpness of charge amount distribution (q/m distribution) than the comparative toner. This suggests that magnetic toner particles are charged uniformly in the magnetic toner used in the present invention.

In the magnetic toner used in the present invention, a sharp distribution of charge amount is obtained by virtue of the combination of the binding resin having specific acid numbers and magnetic iron oxide having specific FeO content. In addition, a good balance is obtained between the acquisition of frictional charges and the leakage of surplus charges, whereby the predetermined friction charge amount can be maintained for a long time.

Hitherto, in copying machines having a magnetic toner make-up mechanism which supplies fresh magnetic toner from a hopper to a developing unit in accordance with consumption, a problem has been encountered in that the image density is occasionally reduced due to non-uniform charging of the toner particles when the fresh magnetic toner from the hopper is mixed in the magnetic toner having a large electrostatic charge around the sleeve of the developing unit.

It should be appreciated that such an occasional reduction in the image density does not take place when the magnetic toner of the present invention is used. This advantageous effect is attributable to the sharp charge amount distribution explained in connection with FIG. 2.

According to the present invention, it is possible to reproduce a latent image on the photosensitive member with a high degree of fidelity even when the latent image is a thin-line image, by virtue of the use of the magnetic toner having specific particle size distribution and containing a specific binding resin and a specific magnetic iron oxide. This magnetic toner also offers a superior reproducibility of halftone or digital dot images and can provide toner images superior in gradation and resolution. This superior effect is maintained even after a long continuous copying or printing operation. In addition, high-density images can be developed with reduced toner consumption as compared with the known toners. Thus, the present invention offers advantages not only in performance but also in economy and size of the copying or printing apparatus.

Furthermore, the above-described magnetic toner used in the method of the present invention remarkably suppresses or substantially eliminates contamination of the fixing roller by the magnetic toner during continuous operation of the copying machine even when the machine is of a high-speed type. Thus, the magnetic-toner used in the method of the present invention can improve fixing characteristic particularly when the ambient temperature is low and effectively prevents reduction in image density which tends to occur due to excessive rise of the charge amount on the magnetic toner when the air humidity is low, thus avoiding fluctuation in the image density over a long time.

In the magnetic toner used in the method of the present invention, independent toner particles are uniformly charged and can hold proper amounts of charges for a long time, by virtue of the combination of the specific binding resin and specific iron oxide.

The magnetic iron oxide contained in the magnetic toner used in the present invention can be prepared, for example, by the following process.

$Fe(OH)_2$ is obtained by neutralizing iron sulfate ($FeSO_4$) with caustic soda and the pH value of the $Fe(OH)_2$ is adjusted to a value from 12 to 13. The $Fe(OH)_2$ is then oxidized in the presence of steam and air, whereby a slurry of magnetite is obtained. The slurry is then dried by a hot-air drier. The dried slurry is then pulverized, whereby a powder of iron oxide such as magnetite is obtained. By suitably controlling the drying time and/or temperature, it is possible to control the FeO content in the magnetic iron oxide to be obtained.

The measurement of FeO in the magnetic iron oxide can be conducted by the following procedure.

A beaker of 500 ml capacity is charged with 1,000 g of the magnetic iron oxide, and 50 ml of de-ionized water is added to the iron oxide. Then, 20 m of special grade sulfuric acid is added to completely dissolve the magnetic iron oxide.

Next, 100 ml of de-ionized water is added and 10 ml of the mixture liquid containing the magnetic iron oxide, followed by addition of 10 ml of a mixture liquid of $MnSO_4$, $H_2SO_4$ and $H_3PO_4$ (mol ratio 0.3: 2.0: 2.0), whereby 180 ml of solution is prepared. Then, 10 ml of this solution is extracted and titrated with 0.1N $KMnO_4$ solution. The FeO content (%) in 1,000 g of the magnetic iron oxide is then determined in accordance with the following formula:

$$FeO(\%)=\{FeO\ equivalent\ of\ N/10KMnO4\times(titrated\ ml-blank\ ml)\}/1000]\times18\times100$$

The magnetic iron oxide preferably has a mean particle size of 0.1 to 2 μm, preferably 0.1 to 0.5 μm. The magnetic iron oxide content in the toner is about 20 to 200 weight parts, preferably 40 to 150 weight parts per 100 weight parts of the resin.

Preferably, the magnetic iron oxide used in the magnetic toner has a coercive force of 20 to 150 Oe, under the influence of magnetism of 10 KOe, as well as a saturation magnetization value of 50 to 200 emu/g and a residual magnetization of 2 to 20 emu/g.

The magnetic toner used in the method of the present invention can further contain one or more dyes or pigments as coloring agents, as required.

Examples of pigments suitably used are carbon black, aniline black, acetylene black, naphthol yellow, Hansa yellow, rhodamine lake, alizarin lake, iron oxide red, phthalocyanine blue, indanthrene blue and so forth. Such a pigment, when used, is added in an amount large enough to provide the required level of the optical density of the fixed image. More specifically, the pigment is added in an amount of 0.1 to 20 weight parts, preferably 2 to 10 weight parts, with respect to 100 weight parts of the resin. Dyes may be used for the same purpose. Example of such dyes are azo dyes, anthraquinone dyes, xanthene dyes and methine dyes. Such a dye is added in an amount of 0.1 to 20 weight parts, preferably 0.3 to 3 weight parts, with respect to 100 weight parts of the resin.

The magnetic toner used in the present invention can contain a charge control agent in order to stabilize the chargeability thereof. Such a charge control agent is used in an amount of 0.1 to 10 weight parts, preferably 0.1 to 5 weight parts, per 100 weight parts of the binding resin.

Various charge control agents are known and available in the field of technology concerned.

For instance, organic metal complexes and chelate compounds are usable as control agents which impart a negative charging characteristic to the magnetic toner. Examples of such agents are mono-azo metal complex, aromatic hydroxy carboxylic acid metal complex and aromatic dicarboxylic acid metal complex. Other examples are aromatic hydroxy carboxylic acid, aromatic monocarboxylic acid and aromatic polycarboxylic acid, as well as metal salts, anhydrides and esters of these acids. It is also possible to use phenol derivatives of bisphenol.

Examples of the charge control agent which imparts a positive charging characteristic to the toner are: nigrosine denaturation product formed from nigrosine and aliphatic acid metal salt; onium salts of tetraammonium salts such as tributylbenzylammonium-1-hydroxy-4-naphthosulfonate and tetrabutylammonium tetra fluoroborate, as well as of phosphonium salts which are analogs to the ammonium salts, and also lake pigments of these salts; triphenyl methane dye and its lake pigments (tungstophosphoric acid, molybdophosphoric acid, tungstomolybdophosphoric acid, tannic acid, lauric acid, gallic acid, ferricyanide or ferrocyanide or the like used as lakefying agent), metal salts of higher fatty acids; and diorganotin oxides such as dibutyltin oxide, dioctyltin oxide and dicyclohexyl tin borate.

Only one of these agents or two or more of these agents in combination may be used in the present invention.

It is also possible to use, as a charge control agent for imparting positive charging characteristic, a polymer of a monomer expressed by the following general formula:

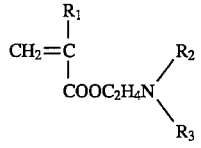

wherein $R_1$ represents H or $CH_3$, and $R_2$ and $R_3$ are alkyl groups which may be substituted.

It is also possible to use, as the charge control agent for imparting a positive charging characteristic, a copolymer of the above-mentioned monomer and aforementioned polymerizable monomer such as ethylene, acrylic acid ester or methacrylic acid ester. In such a case, the charge control agent also serves as a part of the binding resin.

Among the charge control agents listed above, charge control agents which impart a positive charging characteristic, such as nigrosine compounds and tetraammonium salts, are used preferably.

The magnetic toner used in the present invention may contain fine silica powder for the purpose of improving charge stability, developing characteristic, fluidity and durability.

Good results are obtained when the fine silica powder has a specific surface area of at least 30 $m^2/g$, in particular 50 to 400 $m^2/g$, in terms of nitrogen absorption as measured by BET method. The amount of such fine silica powder ranges from 0.01 to 8 weight parts, preferably from 0.1 to 5 weight parts, per 100 weight parts of the toner.

It is also preferred that such fine silica powder is treated for the purpose of rendering the powder hydrophobic and/or for controlling chargeability. The treatment may be conducted, for example, by using silicone varnish, various denaturated silicone varnishes, silicone oil, various denaturated silicone oils, a silane coupling agent or a silane coupling agent having functional groups or other organic silicon-containing compound. Treatment may be conducted by using one of these treating agents or two or more of them simultaneously.

The magnetic toner used in the present invention may further contain one or more of the following additives: a lubricant such as polytetrafluoroethylene, zinc stearate and polyvinylidene fluoride (polyvinylidene fluoride is used most suitably); a grinding agent such as cerium oxide, silicon carbide and strontium titanate (strontium titanate is used most suitably); a fluidizing agent such as titanium oxide and aluminum oxide (preferably, this agent is hydrophobic); an anti-caking agent; a conductivity donator such as carbon black, zinc oxide, antimony oxide and tin oxide; and a development promoting agent such as white or black fine particles of a polarity opposite to that of the toner.

In one of the preferred forms of the present invention, a waxy-type substance may be added in an amount of 0.5 to 10 wt % per 100 wt % of the binder resin, in order to improve separation of the toner from the heat roll after fixing of a transferred image. Examples of such waxy-type substance are low-molecular polypropylene, microcrystalline wax, carnauba wax, sazole wax and paraffin wax.

The magnetic toner used in the present invention may be produced by: preparing a mixture of the aforementioned binding resin, magnetic iron oxide and, as necessary, charge control agent and anti-offset agent; sufficiently agitating the mixture to uniformly mix these components in a mixing device such as a Henschel mixer or a ball mill; melting and kneading the mixture by a heat-kneading device such as a heat roll, kneader or an extruder so as to completely mix the component resins; dispersing or dissolving the magnetic iron oxide in the kneaded mixture; cooling the mixture to solidify it followed by pulverization and a highly-accurate classification; whereby the magnetic toner is obtained.

The magnetic toner thus prepared may be treated as desired with one or more of the aforesaid additives in a mixing device such as a Henschel mixer so that the magnetic toner particles have these additives in their surfaces.

In the present invention, the amount of charge on the magnetic toner layer carried by the developing sleeve is measured by a so-called suction-type Faraday cage method. This method employs (a) a suction outer cylinder which is pressed onto a region of a constant area on the developing sleeve so as to vacuum substantially all the magnetic toner particles from this region, and (b) an inner cylinder having a filter which arrests all the vacuumed magnetic toner particles. The weight of the toner layer per unit area on the developing sleeve surface, therefore, can be determined by measuring the increment of the weight of the filter. At the same time, the amount of charges accumulated in the inner cylinder, which is electrostatically shielded from the exterior, is measured, and the amount of charges on the developing sleeve is determined from the measured value of the charges accumulated in the inner cylinder.

In the present invention, the line-image reproducibility was measured by the following method. An original image of a thin line of exactly 100 μm wide was prepared, and was copied under proper copying conditions thus obtaining measurement samples. The measurement was conducted by using a LUSEX 450 particle analyzer as the measuring device. More specifically, the widths of images of the lines of the measurement samples, displayed on a monitor display at a magnification, were measured by an indicator. In the magnified line image, the edges of the lines were roughened to vary the line widths. The measurement of the width was therefore conducted on the basis of an imaginary edge line which is scribed at the the mean of the protrusions and recesses of the edge line. On the basis of the thus measured image line width, the thin-line image reproducibility was determined by the following formula:

{(measured line width of copied line image)/(line width of original line)(50μm)}×100

According to the present invention, the resolution was measured by the following method. Original images were prepared which are composed of patterns having five thin lines of an equal line width and arranged at predetermined pitches. Twelve such thin-line patterns were prepared to have different pitch lines, i.e., 2.8, 3.2, 3.6, 4.0, 4.5, 5.0, 5.6, 6.3, 7.1, 8.0, 9.0 and 10.0 lines per 1 mm. The original image having such twelve thin-line patterns was copied under proper copying condition and the copy image was observed through a magnifier. The maximum number of the line images (lines per 1 mm) which were observed to be discrete was determined as the resolution. Thus, the greater the line number the higher the resolution.

The invention will be more fully understood from the following description of Synthesis Examples and Embodiments of the invention.

The description will be commenced first with Examples of synthesis of the binding resin used in the magnetic toner employed by the method of the present invention. The total acid numbers (A), JIS acid numbers, total acid numbers (B) derived from acid anhydrides and the values of {(B)/(A)}× 100 of the binding resin and intermediate resin used in Examples are shown in Tables 1, 2-1 and 2-2.

The charge amount distributions (q/m distributions) of the magnetic toners of Examples and Comparative Examples which will be shown later were measured immediately before the test copying operation and after the test copying operation in a low-temperature and low-humidity environmental condition.

A detailed description will be given of the magnetic toners used in Examples and Comparative Examples. The description will begin with Examples of synthesis of the binding resin used in the magnetic toner which is employed in the method of the present invention.

Synthesis Example 1

A mixture having the following composition was prepared:

| | |
|---|---|
| styrene | 76.5 weight parts |
| butylacrylate | 13.5 weight parts |
| monobutyl maleate | 10.0 weight parts |
| di-tert-butylperoxide | 6.0 weight parts |

The above-mentioned mixture was dripped in four hours into 200 weight parts of xylene which has been heated to reflux temperature. The mixture was made to polymerize in the refluxed xylene (138° to 144° C.). Then, pressure was reduced and the temperature was elevated to 200° C. so as to remove the xylene. The resin thus formed will be referred to as "resin A", hereafetr.

A mixture liquid having the following composition was prepared by using the above-mentioned resin A.

| | |
|---|---|
| resin A | 30.0 weight parts |
| styrene | 46.0 weight parts |
| butylacrylate | 21.0 weight parts |
| monobutyl maleate | 3.0 weight parts |
| divinylbenzene | 0.4 weight parts |
| benzoyl peroxide | 1.5 weight parts |

170 weight parts of water, containing 0.12 weight parts of partial saponified product of polyvinyl alcohol, was added to the above-mentioned mixture liquid, and the mixture was vigorously agitated to become a suspension dispersion liquid. This suspension dispersion liquid was charged into a reaction vessel containing 50 weight parts of water and having a nitrogen atmosphere thus allowing the liquid to suspension-polymerize for 8 hours at 80° C. After the reaction,the product was taken out and rinsed, dehydrated and dried, whereby a resin B was obtained.

Synthesis Example 2

A resin C was obtained from a compound having the following composition, in the same manner as that in Synthesis Example 1

| | |
|---|---|
| styrene | 67.5 weight parts |
| butylacrylate | 17.5 weight parts |
| monobutylmaleate | 15.0 weight parts |
| di-tert-butylperoxide | 6.0 weight parts |

A resin D was prepared from a compound having the following composition using the same method as that in Synthesis Example 1.

| | |
|---|---|
| resin C | 30.0 weight parts |
| styrene | 45.0 weight parts |
| butylacrylate | 20.0 weight parts |
| monobutyl maleate | 5.0 weight parts |
| divinylbenzene | 0.4 weight parts |
| benzoyl peroxide | 1.5 weight parts |

Synthesis Example 3

A composition having the following composition was dripped over 4 hours into 200 weight parts of xylene heated to refluxing temperature.

| | |
|---|---|
| styrene | 70.0 weight parts |
| butylacrylate | 22.0 weight parts |
| monobutyl maleate | 8.0 weight parts |
| divinylbenzene | 1.0 weight parts |
| di-tert-butyl peroxide | 4.0 weight parts |

The compound was polymerized in the refluxed xylene (138° to 144° C.). Then, pressure was reduced and the temperature was elevated to 200° C. so as to remove the xylene. The resin thus formed will be referred to as "resin E", hereinafter.

The total acid values (A), JIS acid values, total acid numbers (B) derived from acid anhydrides and the ratio {(B)/(A)}×100 of the total acid number (B) derived from acid anhydrides to the total acid number (A) of the whole resin are shown in Table 1.

TABLE 1

| | Total acid value of resin (A) | JIS acid value of resin | Total acid value from anhydride (B) | {(B)/(A)} × 100% | Presence of 1780 $cm^{-1}$ in IR spectral absorption |
|---|---|---|---|---|---|
| Resin B | 21.3 | 20.0 | 2.6 | 12 | Peak observed |
| Resin C | 34.6 | 33.8 | 1.6 | 5 | Peak observed |
| Resin E* | 31.8 | 19.8 | 27.0 | 85 | Peak observed |

*Resin E is a Comparative resin

Illustrative preparations of magnetic iron oxide employed in the inventive magnetic toner are provided as follows:

Magnetic Iron Oxide Preparation Example 1

A mixture system was prepared by mixing, in a 4 l flask having three ports, 1 l of 0.8M aqueous solution of $FeSO_4$ and 1 l of 0.85M aqueous solution of caustic soda. Steam and oxygen were blown into the mixture system so that the temperature of the mixture was raised to 70° C. to promote oxidation of the mixture, Black powder particles obtained by this process were rinsed and subjected to a primary drying in which the powder was dried at 130° C. for 10 minutes, followed by a secondary drying in which the powder was dried at 80° C. for 2 hours, whereby an iron oxide powder containing 26.1 wt % of FeO was obtained.

Magnetic Iron Oxide Preparation Example 2

Iron oxide powder was prepared by the same process as Example 1 except that the primary drying was conducted at 120° C. for 15 minutes and the secondary drying was conducted at 75° C. for 2.5 hours. As a consequence, magnetic iron oxide powder containing 25.4 wt % of FeO was obtained.

Magnetic Iron Oxide Preparation Example 3

Iron oxide powder was prepared by the same process as Example 1 except that the primary drying was conducted at 65° C. for 15 hours. As a consequence, magnetic iron oxide powder containing 28.1 wt % of FeO was obtained.

Magnetic Iron Oxide Preparation Example 4

Iron oxide powder was prepared by the same process as Example 1 except that the drying was conducted in one step at 70° C. for 10 hours. As a consequence, magnetic iron oxide powder containing 27.2 wt % of FeO was obtained.

Magnetic Iron Oxide Preparation Comparative Example 1

Iron oxide powder was prepared by the same process as Example 1 except that the drying was conducted in one step at 130° C. for 1.5 hours. As a consequence, magnetic iron oxide powder containing 23.0 wt % of FeO was obtained.

Magnetic Iron Oxide Preparation Comparative Example 2

Iron oxide powder was prepared by the same process as Example 1 except that the drying was conducted at 75° C. for 18 hours, followed by 15-hour preservation in $H_2$ atmosphere. As a consequence, magnetic iron oxide powder containing 30.5 wt % of FeO was obtained.

Drying conditions and FeO contents of the above-mentioned magnetic iron oxides are shown in Tables 2.

Examples of preparation of the magnetic toner used in the present invention are provided as follows:

Toner Preparation Example 1.

TABLE 2

| | Drying conditions | | | | |
|---|---|---|---|---|---|
| | Primary drying temp. | Primary drying time | Secondary drying temp. | Secondary drying time | FeO (%) |
| Example 1 | 130° C. | 10 minutes | 80° C. | 2 hours | 26.1 |
| Example 2 | 120° C. | 15 minutes | 75° C. | 2.5 hours | 25.4 |
| | Drying Temp. | | Drying Time | | FeO (%) |
| Example 3 | 65° C. | | 15 hours | | 26.1 |
| Example 4 | 70° C. | | 10 hours | | 27.2 |
| Comp.Ex. 1 | 130° C. | | 1.5 hours | | 23.0 |
| Comp.Ex. 4 | 75° C. | | 18 hours* | | 30.5 |

*After 50-hour shelving at 50° C., shelved 15 hours in $H_2$ atmosphere

A mixture was formed from the following components and was sufficiently blended to form a relatively uniform mixture.

| | |
|---|---|
| Resin B | 100 weight parts |

Magnetic iron oxide of
Magnetic Iron Oxide Preparation Example 1 80 weight parts (particle-number-mean particle size 0.2 μm, saturation magnetization about 80 emu/g, residual magnetization about 11 emu/g, coercive force (Hc) about 120 Oe)

Low molecular weight ethylene-propylene copolymer 3 weight parts

| | |
|---|---|
| Negative charge control agent | 2 weight parts |

The mixture was then kneaded by a twin-screw kneading extruder set at 150° C., and the kneaded product was cooled and then coarsely crushed by a cutter mill, followed by pulverization into fine particles by means of a pulverizing machine using a jet stream. The particles thus obtained were classified by a stationary-wall type air classifier. The classified powder was then subjected to a futher classification in which ultra-fine powders and coarse powders were simultaneously removed with a high degree of accuracy by means of a multi-class classifier (Elbow Jet Classifier produced by Nittetsu Kogyo) which utilized the Coanda effect, whereby electrically insulating black fine powder having negative chargeability was obtained as the magnetic toner. The particle size distribution of this toner is shown in Table 3.

100 weight parts of the thus-obtained magnetic toner and 0.6 weight parts of hydrophobic dry silica fine powder (BET specific surface area 300 $m^2/g$) were mixed together by a Henschel mixer, whereby a magnetic toner having fine silica particles on the surface of the toner particle was obtained. This magnetic toner will be referred to as Toner No. 1.

Toner Preparation Example 2

A magnetic toner having a particle size distribution as shown in Table 3 was prepared by the same process as Example 1 from the following components.

| | |
|---|---|
| Resin B | 100 weight parts |
| Iron oxide of Magnetic Oxide Preparation Example 2 | 100 weight parts |
| Low molecular weight ethylene-propylene copolymer | 4 weight parts |
| Negative charging charge control agent | 2 weight parts |

100 weight parts of the thus-obtained magnetic toner and 0.8 weight parts of hydrophobic dry silica fine powder (BET specific surface area 200 $m^2/g$) were mixed together by a Henschel mixer, whereby a magnetic toner was obtained. This magnetic toner will be referred to as Toner No. 2.

Toner Preparation Example 2

A magnetic toner having a particle size distribution as shown in Table 3 was prepared by the same process as Example 1 from the following components.

| | |
|---|---|
| Resin D | 100 weight parts |
| Iron oxide of Magnetic Oxide Preparation Example 3 | 70 weight parts |
| Low molecular weight ethylene-propylene copolymer | 4 weight parts |
| Negative charge control agent | 2 weight parts |

This magnetic toner will be referred to as Toner No. 3.

Toner Preparation Example 4

A magnetic toner having a particle size distribution as shown in Table 3 was prepared by the same process as Example 2 from the following components.

| | |
|---|---|
| Resin D | 100 weight parts |
| Iron oxide of Magnetic Iron Oxide Preparation Example 4 | 90 weight parts |
| Low molecular weight ethylene-propylene copolymer | 3 weight parts |
| Negative charge control agent | 2 weight parts |

This magnetic toner will be referred to as Toner No. 4.

Comparative Toner Preparation Examples 1 and 2

Comparative toner Nos. 1 and 2 were prepared by using coarsely crushed product obtained in Toner Preparation Example 1 in the same process as Example 1 except that fine classifying conditions were changed.

Comparative Toner Preparation Example 3

A comparative toner No. 3, having a particle size distribution as shown in Table 3, was obtained by the same process as Toner Preparation Example 1, except that Comparative Resin E was used in place of the resin B.

Comparative Toner Preparation Example 4

A comparative toner No. 4, having a particle size distribution as shown in Table 3, was obtained by the same process as Toner Preparation Example 1, except that Comparative Resin E was used in place of the resin B and magnetic iron oxide of Comparative Example 1 was used in place of the magnetic iron oxide used in Toner Preparation Example 1.

Comparative Toner Preparation Example 5

A comparative toner No. 5, having a particle size distribution as shown in Table 3, was obtained by the same process as Toner Preparation Example 1, except that Comparative Resin E was used in place of the resin B and magnetic iron oxide of Comparative Example 2 was used in place of the magnetic iron oxide used in Toner Preparation Example 1.

TABLE 3

| Toner No. | Toner particle size distribution: Number N (%) of particles ≦ 5 μm | Vo. (%) of particles ≧ 16 μm | Number (%) of particles 8 to 12.7 μm | Volume mean particle size (μm) | Number N (%) of particles ≦ 5' μm/Vol (%) |
|---|---|---|---|---|---|
| No. 1 | 34.5 | 0.0 | 16.5 | 8.12 | 3.4 |
| No. 2 | 46.5 | 0.1 | 4.5 | 6.21 | 2.5 |
| No. 3 | 31.2 | 0.2 | 27.6 | 8.81 | 4.8 |
| No. 4 | 24.1 | 0.0 | 14.5 | 7.10 | 3.1 |
| Comp. No. 1 | 16.1 | 0.8 | 39.2 | 8.36 | 4.5 |
| Comp. No. 2 | 28.1 | 6.1 | 28.4 | 8.21 | 4.5 |
| Comp. No. 3 | 34.8 | 0.0 | 16.3 | 8.10 | 3.1 |
| Comp. No. 4 | 35.0 | 0.1 | 16.0 | 8,20 | 3.0 |
| Comp. No. 5 | 34.1 | 0.1 | 16.8 | 8.15 | 3.6 |

Examples of the waveforms of the developing bias voltages used in the image forming method of the present invention and Comparative Examples of image forming method are provided in the following Waveform Examples.

Waveform Example 1

A developing bias power supply capable of applying an A.C. bias electric field as shown in FIG. 4 was used as the power supply. This bias electric field was formed by applying a composite voltage obtained by superposing the following A.C. voltage $S_0$ to a D.C. voltage $S_1$ of +200 V.

| | |
|---|---|
| peak to peak | 1400 V |
| frequency | 2000 Hz |
| duty ratio | 20% |

Waveform Example 2

Figure 5:
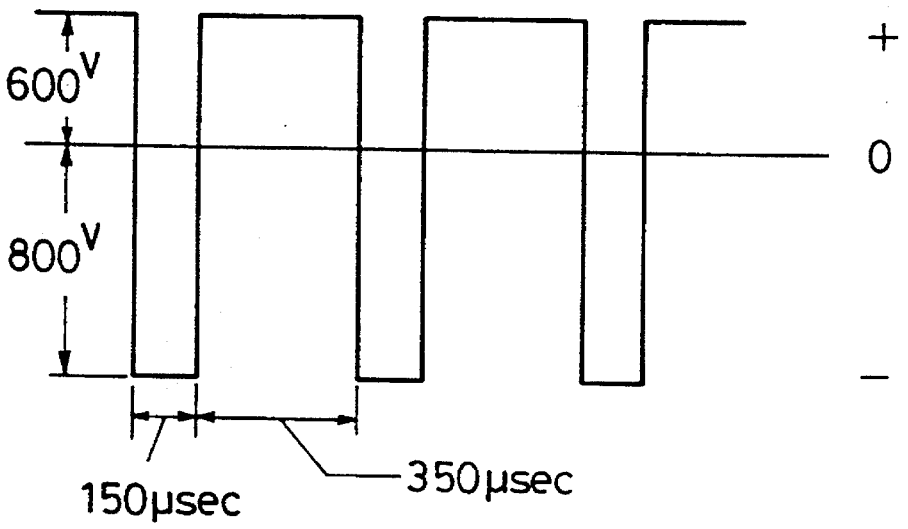

A developing bias power supply capable of applying an A.C. bias electric field as shown in FIG. 5 was used as the power supply. This bias electric field was formed by applying a composite voltage obtained by superposing the following A.C. voltage $S_0$ to a D.C. voltage $S_1$ of +200 V.

| | |
|---|---|
| peak to peak | 1400 V |
| frequency | 2000 Hz |
| duty ratio | 30% |

Waveform Example 3

Figure 6:
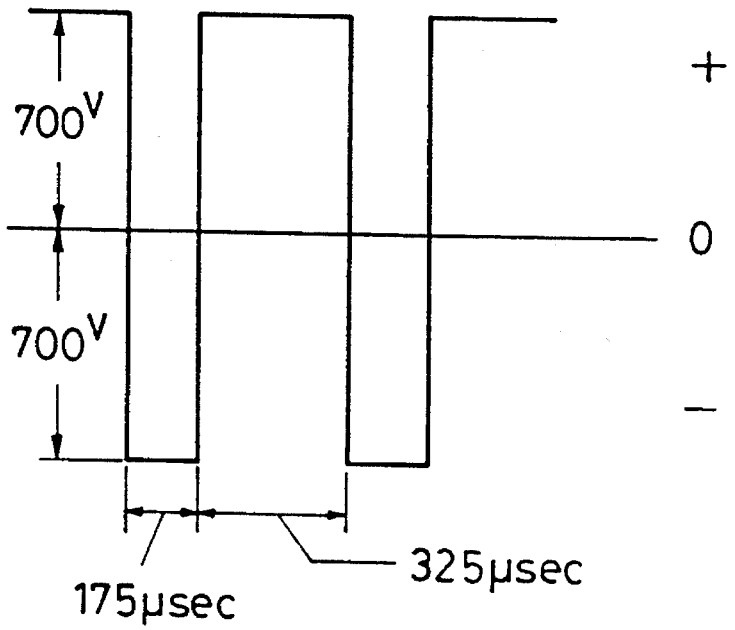

A developing bias power supply capable of applying an A.C. bias electric field as shown in FIG. 6 was used as the power supply. This bias electric field was formed by applying a composite voltage obtained by superposing the following A.C. voltage $S_0$ to a D.C. voltage $S_1$ of +200 V.

| | |
|---|---|
| peak to peak | 1400 V |
| frequency | 2000 Hz |
| duty ratio | 35% |

Waveform Example 4

Figure 7:
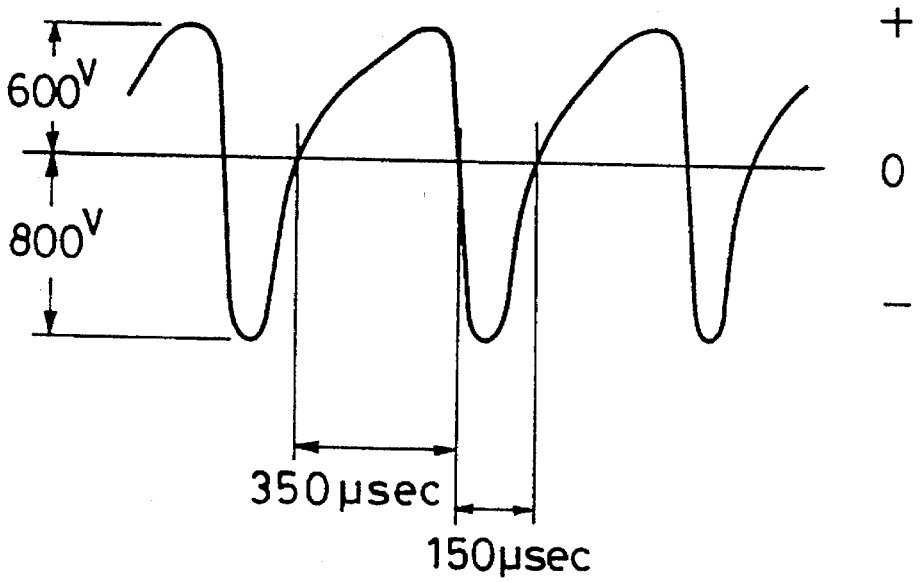

A developing bias power supply capable of applying an A.C. bias electric field as shown in FIG. 7 was used as the power supply. This bias electric field was formed by applying a composite voltage obtained by superposing the following A.C. voltage $S_0$ to a D.C. voltage $S_1$ of +200 V.

| | |
|---|---|
| peak to peak | 1400 V |
| frequency | 2000 Hz |
| duty ratio | 30% |

Waveform Example 5

Figure 8:
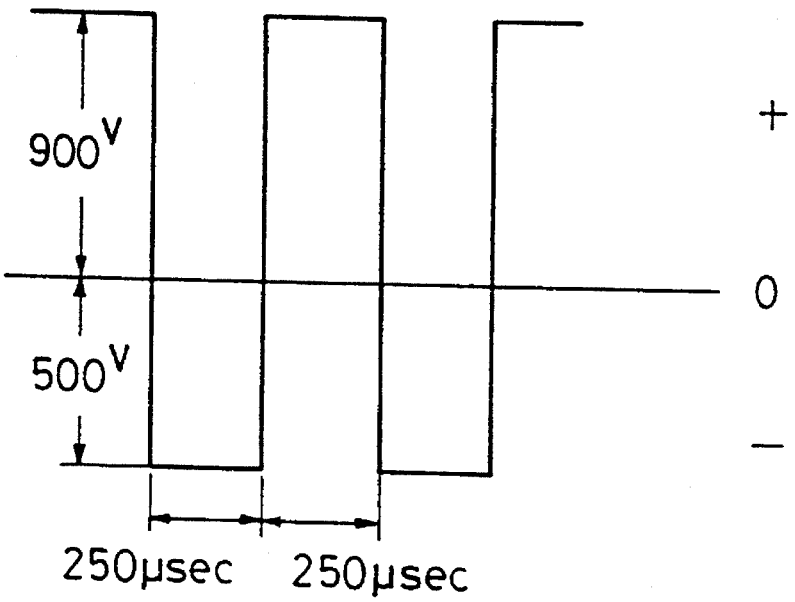
FIG. 8 is a schematic illustration of a symmetrical alternating bias voltage.
Figure 9:
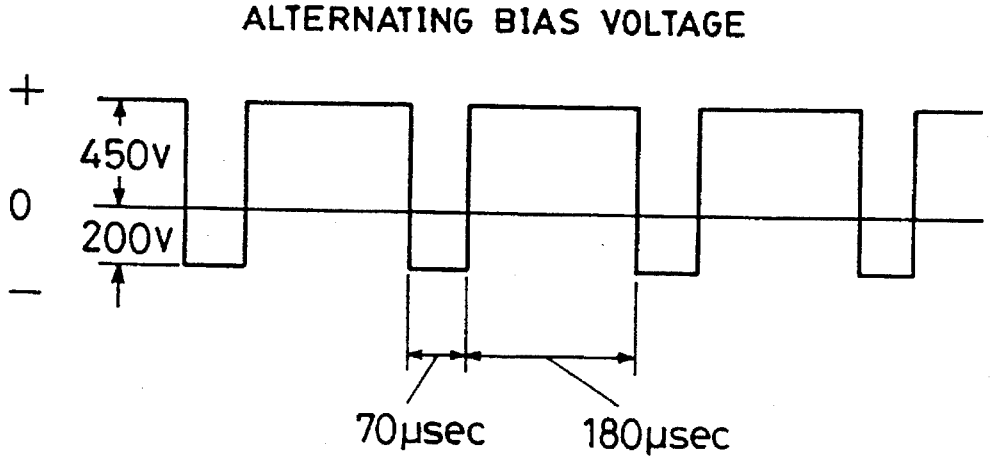
FIGS. 9 and 11 are schematic illustrations of waveforms of a comparative example of alternating bias voltage.
Figure 10:
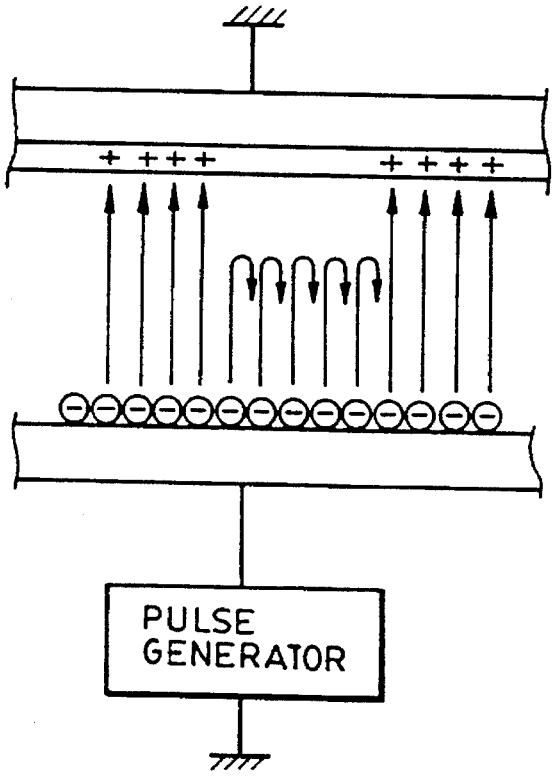
FIG. 10 is a schematic illustration of a developing section of a prior art copying apparatus, showing the manner of conveyance of toner particles.
Figure 11:
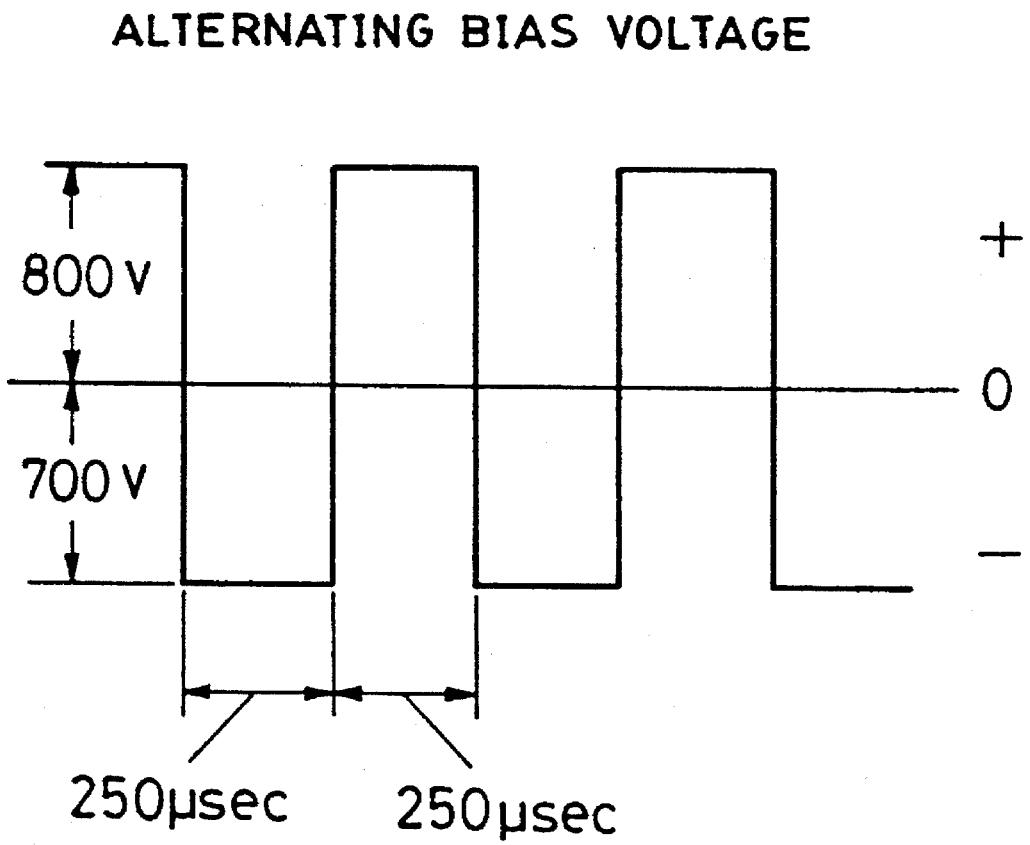

A developing bias power supply capable of applying an A.C. bias electric field as shown in FIG. 8 was used as the power supply (Comparative Example). This bias electric field was formed by applying a composite voltage obtained by superposing the following A.C. voltage $S_0$ to a D.C. voltage $S_1$ of +200 V.

| | |
|---|---|
| peak to peak | 1400 V |
| frequency | 2000 Hz |
| duty ratio | 50% |

The following illustrative examples show typical image forming and image fixing carried out with the present process.

Example Nos. 1 to 7 of Image Forming Process

Image-forming tests, as well as tests for examining fixing characteristic with heat roller, were conducted by employing a modified copying machine (modified from commercially available copying machine NP-8580 produced by Canon Inc.), using Toner Nos. 1 to 4 as the magnetic toner. The modified copying machine had an a-Si photosensitive drum as the latent image carrier 1. The size of the gap α between the latent image carrier 1 and the developing sleeve 22 was set to 0.3 mm. The size of the gap between the developing sleeve 22 and the magnetic doctor blade 24 was 0.25 mm, while the thickness of the toner layer on the developing sleeve was about 120 μm. The strength of the magnet used as the magnetic roller 23 in the developing roller 22 was such as to produce magnetic flux densities of 1000 gauss, 1000 gauss, 750 gauss and 550 gauss on the portions of the sleeve surface near the $N_1$, $S_1$, $N_2$ and $S_2$ poles, respectively.

The copying tests were conducted at a rate of 80 copy sheets of A-4 size per minute under varying atmospheric conditions: namely, at normal temperature and normal humidity (23.5° C., 60% RH), at low temperature and low humidity (15° C., 10% RH) and at high temperature and high humidity (32.5° C., 85% RH).

Under the condition of normal temperature and normal humidity (23.5° C., 60% RH), all the toners of the Examples and the Comparative Examples provided copy images of high quality even after production of 100,000 copies. However, the quality of the copy image showed a wide variation after production of 100,000 copies under the condition of low temperature and low humidity (15° C., 10% RH), as will be seen from Table 4.

The fixing characteristics of the magnetic toners was conducted in accordance with the following procedure. Two types of the modified copying machine, one having a fixing device incorporating a fluoro-resin coated heat/press fixing roller and the other having a fixing device incorporating a silicone-rubber-coated heat/press fixing roller, were used. The copying machines were held overnight in an atmosphere of low temperature and low humidity (15° C., 10%) so that the temperature and humidity of and around the fixing devices were completely settled at the above-mentioned levels of temperature and humidity. Test operations were then commenced at a fixing temperature of 180° C. to successively produce 200 copies and the 200th copy was subjected to evaluation of its fixing characteristics. The valuation was conducted by rubbing the fixed image 100 times, each rubbing stroke including one forward and one backward stroke under a load of 100 g, with a lens cleaning paper "dust or R" (produced by OZU paper Co., Ltd.). The degree of peeling of the image in terms of the ratio (%) of reduction in the reflection density was examined and evaluated. The results are also shown in Table 4.

Comparative Example 1 of Image Forming Process

An image forming test was conducted in the same way as Example 1 except that the Comparative Toner No. 3, containing a binding resin in which the ratio of the acid number (B) derived from anhydrides with respect to the total acid number (A) of the binding resin is 85%, was used as the toner. A continuous copying test was conducted under an atmosphere of low temperature and humidity (15° C., 10% RH). A white stripe-like image defect, as well as a reduction in the image density, became noticeable after production of 10000 copies. The image density was reduced to 1.09 when the number of the copies reached 15000. The amount of charges on the magnetic toner held by the developing sleeve, as observed after production of about 15000 copies, was as great as −29.8 μc/g, thus exhibiting a tendency of excessive charging of the toner.

Comparative Example 2

An image forming test was conducted in the same way as Example 1 except that the Comparative Toner No. 4, containing a binding resin in which the ratio of the acid number (B) derived from anhydrides with respect to the total acid number (A) of the binding resin is 85% and containing also the magnetic iron oxide having a ferrous oxide content of 23 wt %, was used as the toner. A continuous copying test was conducted under an atmosphere of low temperature and humidity (15° C., 10% RH). A white stripe-like image defect, as well as a reduction in the image density, became noticeable after production of 6000 copies. The image density was reduced to 1.04 when the number of the copies has reached 10000. The amount of charges on the magnetic toner held by the developing sleeve, as observed after production of about 10000 copies, was as great as −31.1 μc/g, thus exhibiting a tendency of excessive charging of the toner.

Comparative Example 3

An image forming test was conducted in the same way as Example 1 except that the Comparative Toner No. 5, containing a binding resin in which the ratio of the acid number (B) derived from anhydrides with respect to the total acid number (A) of the binding resin is 85% and containing also the magnetic iron oxide having a ferrous oxide content of 30.5 wt %, was used as the toner. A continuous copying test was conducted under an atmosphere of low temperature and humidity (15° C., 10% RH). A white stripe-like image defect, as well as a reduction in the image density, became noticeable after production of 7000 copies. The image density was reduced to 1.01 when the number of the copies has reached 8000. The amount of charges on the magnetic toner held by the developing sleeve, as observed after production of about 8000 copies, was as great as −32.2 μc/g, thus exhibiting a tendency of excessive charging of the toner. A continuous image forming test also was conducted under the condition of an elevated temperature and humidity (32.5° C., 85%RH). A reduction in the image density due to a reduction in the efficiency of transfer of the toner to the copy paper, attributable to a reduction in the amount of charges on the toner held by the developing sleeve, became noticeable after production of about 8000 copies. The image density after production of about 10000 copies was as low as 1.01.

Comparative Example 4

An image forming test was conducted employing the procedure of Example 1 with the exception that Comparative Toner 1 was employed as the toner. Although satisfactory images were obtained, consumption of the toner was excessive.

Comparative Example 5

An image forming test was conducted employing the same procedure as Example 1 except that the Comparative Toner No. 2 was employed. Although satisfactory image quality was obtained initially, the image quality progressively degraded. In particular, the thin-line image reproducibility was variable so that resolution was degraded.

Comparative Example 6

An image-forming test was conducted in the same way as Example 1 except that a developing bias voltage having a duty ratio of 50% was used. The toner images showed dragging, as well as inferior gradation and resolution.

As will be understood from the foregoing description, the image forming method in accordance with the present invention makes it possible to obtain clear images having no substantial fog and being superior both in thin-line image reproducibility and gradation over a long period of use. In particular, images of high density and clearness without any fog can be obtained even when the copying operation is conducted in ambient air of a low humidity, This invention is not to be limited except as set forth in the claims which follow:

TABLE 4

RESULTS OF 100000 COPY CYCLE TEST UNDER LOW TEMP./HUMIDITY CONDITION

| | Developing bias power | | Magnetic toner | | | Density | Initial Thin-line Reproducibility | Thin-line Reproducibility | Initial Resolution | Resolution | | q/m Distribution Width | q/m Distribution After |
|---|---|---|---|---|---|---|---|---|---|---|---|---|---|
| | No. | Duty ratio (%) | No. | Volume-mean particle size μm | Initial density | After 100,000 copies | Reproducibility % | after 100,000 copies % | lines/mm | after 100,000 Copies | Fixing Rate % | Before Test μc/g | 100,000 Copies μc/g |
| Example 1 | 1 | 20 | 1 | 8 | 1.38 | 1.41 | 102 | 103 | 7.1 | 7.1 | 5.1 | 25 | 28 |
| Example 2 | 3 | 35 | 2 | 6 | 1.36 | 1.37 | 101 | 104 | 9.0 | 9.0 | 6.2 | 23 | 24 |
| Example 3 | 2 | 30 | 3 | 9 | 1.38 | 1.39 | 105 | 106 | 6.3 | 5.6 | 8.5 | 28 | 30 |
| Example 4 | 1 | 20 | 4 | 7 | 1.35 | 1.37 | 103 | 102 | 8.0 | 7.1 | 10.2 | 27 | 27 |
| Example 5 | 4 | 30 | 1 | 8 | 1.41 | 1.42 | 109 | 110 | 7.1 | 6.3 | 5.1 | 26 | 30 |
| Example 6 | 2 | 30 | 3 | 9 | 1.40 | 1.40 | 107 | 103 | 7.1 | 5.6 | 8.5 | 28 | 26 |
| Example 7 | 1 | 20 | 4 | 7 | 1.37 | 1.41 | 101 | 104 | 6.3 | 6.3 | 10.2 | 29 | 28 |
| Comp. Example 1 | 1 | 20 | Comp. 3 | 8 | 1.38 | 1.09[1)] | 110 | — | 7.1 | — | 11.1 | 45 | 58[1)] |
| Comp. Example 2 | 1 | 20 | Comp. 4 | 8 | 1.37 | 1.04[2)] | 109 | — | 6.3 | — | 6.5 | 48 | 50[2)] |
| Comp. Example 3 | 1 | 20 | Comp. 5 | 8 | 1.35 | 1.01[3)] | 108 | — | 7.1 | — | 6.3 | 50 | 55[3)] |
| Comp. Example 4 | 1 | 20 | Comp. 1 | 8 | 1.34 | 1.36 | 115 | 120 | 7.1 | 5.6 | 7.2 | 28 | 35 |
| Comp. Example 5 | 1 | 20 | Comp. 2 | 8 | 1.35 | 1.37 | 111 | 75–120 | 8.0 | 3.6 | 6.9 | 29 | 48 |
| Comp. Example 6 | 5 | 50 | 1 | 8 | 1.33 | 1.36 | 110 | 68–105 | 6.3 | 3.2 | 5.1 | 26 | 43 |

[1)]Density and q/m distribution width after 15,000 copies are shown. Test stopped at 15,000 copies.
[2)]Density and q/m distribution width after 10,000 copies are shown. Test stopped at 10,000 copies.
[3)]Density and q/m distribution width after 8,000 copies are shown. Test stopped at 8,000 copies.

What is claimed is:

1. A magnetic toner comprising: a binding resin and a magnetic iron oxide;

wherein said magnetic toner has a particle size distribution in which 12% or more by number of the magnetic toner particles are 5 μm or smaller and 33% or less by number of the magnetic toner particles are 8 to 12.7 μm and in which magnetic toner particles not smaller than 16 μm exist in an amount not greater than 2.0% in terms of volume, with the volume mean particle size of said magnetic toner particles ranging from 4 to 10 μm; and said binding resin has an overall acid value (A) of 2 to 100 mgKOH/g as measured through hydrolysis of acid anhydride groups in said binding resin and a total acid value (B) derived from said acid anhydrides below 6 mgKOH/g, the ratio (B)/(A) being not greater than 0.6.

2. A magnetic toner according to claim 1, wherein said magnetic iron oxide has an FeO content between 25 to 30 wt. % based on total weight of the magnetic iron oxide.

3. A magnetic toner according to claim 1, wherein said binding resin has said overall acid number (A) ranging from 5 to 70 mgKOH/g, and the content of said magnetic iron oxide is from 20 to 200 weight parts per 100 weight parts of said binding resin.

4. A magnetic toner according to claim 3, wherein said binding resin has said overall acid number (A) ranging from 5 to 50 mgKOH/g, and the content of said magnetic iron oxide is from 40 to 150 weight parts per 100 weight parts of said binding resin.

5. A magnetic toner according to claim 1, wherein said magnetic iron oxide has a mean particle size ranging from 0.1 to 0.5 μm.

6. A magnetic toner according to claim 11, wherein said binding resin has said ratio (B)/(A) ranging from 0.01 to 0.6.

7. A magnetic toner according to claim 1, wherein said binding resin has said ratio (B)/(A) ranging from 0.02 to 0.5.

8. A magnetic toner according to claim 1, wherein said binding resin has said ratio (B)/(A) ranging from 0.03 to 0.4.

9. A magnetic toner according to claim 1, wherein said magnetic toner contains 12 to 60% of magnetic toner particles of 5 μm or smaller in terms of the number of the magnetic toner particles.

10. A magnetic toner according to claim 1, wherein said magnetic toner contains 12 to 60% of magnetic toner particles of 5 μm or smaller in terms of the number of the magnetic toner particles and has a volume mean particle size of 6 to 10 μm, said magnetic toner further satisfying the following conditions:

$$N/V=-0.04N+K$$

where N is the content of the magnetic toner particles 5 μm or smaller in terms of the number of the magnetic toner particles which ranges from 12 to 60, V represents the volume (%) of the magnetic toner particles of 5 μm or smaller, and K represents a constant ranging from 4.5 to 6.5.

11. A magnetic toner according to claim 1, wherein said magnetic toner has a volume mean particle size of 6 to 10 μm, said magnetic toner further satisfying the following conditions:

$$N/V=-0.04N+K$$

where N is the content of the magnetic toner particles of 5 μm or smaller in terms of the number of the magnetic toner particles which ranges from 12 to 60, V represents the volume (%) of the magnetic toner particles of 5 μm or smaller, and K represents a constant ranging from 4.5 to 6.5.

* * * * *

UNITED STATES PATENT AND TRADEMARK OFFICE

CERTIFICATE OF CORRECTION

PATENT NO. : 5,504,272

DATED : April 2, 1996

INVENTOR(S) : MASAKI UCHIYAMA ET AL.

It is certified that error appears in the above-identified patent and that said Letters Patent is hereby corrected as shown below:

COLUMN 2

Line 29, "high resistance" should read --high-resistance--.

COLUMN 3

Line 2, "allows" should read --which allows--.
Line 16, "quality,durability" should read --quality, durability--.
Line 19, "have" should read --has--.

COLUMN 4

Line 20, "having" should read --having a--.
Line 24, "dispersed,through" should read --dispersed, through--.

COLUMN 5

Line 30, "are magnetic" should read --magnetic--.
Line 31, "of 8" should read --are 8--.

COLUMN 6

Line 21, "the the" should read --the--.
Line 31, "8 μor" should read --8 μm or--.

UNITED STATES PATENT AND TRADEMARK OFFICE

CERTIFICATE OF CORRECTION

PATENT NO. : 5,504,272

DATED : April 2, 1996

INVENTOR(S) : MASAKI UCHIYAMA ET AL.

It is certified that error appears in the above-identified patent and that said Letters Patent is hereby corrected as shown below:

COLUMN 7

Line 54, "invention,the" should read --invention, the--.

COLUMN 8

Line 47, "gap," should read --gap--.

COLUMN 9

Line 4, "Thus,a" should read --Thus, a--.

COLUMN 13

Line 1, "a" should be deleted.
Line 36, "8 of" should read --8 to--.

COLUMN 15

Line 29, "denotes" should read --denote--.

COLUMN 16

Line 51, "The" should read --¶ The--.

COLUMN 18

Line 37, "acid" should read --an acid--.

UNITED STATES PATENT AND TRADEMARK OFFICE

CERTIFICATE OF CORRECTION

PATENT NO. : 5,504,272

DATED : April 2, 1996

INVENTOR(S) : MASAKI UCHIYAMA ET AL. Page 3 of 5

It is certified that error appears in the above-identified patent and that said Letters Patent is hereby corrected as shown below:

COLUMN 19

Line 5, "p-n-dedocyl" should read --p-n-dodecyl--.
Line 27, "α," should read --α-,--.

COLUMN 20

Line 48, "JISacid" should read --JIS acid--.

COLUMN 21

Line 56, "acid,dicarboxylic" should read --acid, dicarboxylic--.

COLUMN 22

Line 7, "to open" should read --open--.
Line 16, "process,another" should read --process, another--.
Line 18, "maybe" should read --may be--.
Line 21, "maybe" should read --may be--.
Line 53, "to" should be deleted.

COLUMN 24

Line 20, "magnetic-toner" should read --magnetic toner--.
Line 60 "N/10KMnO4" should read --N/10$KMnO_4$--.

COLUMN 25

Line 17, "Example" should read --Examples--.

UNITED STATES PATENT AND TRADEMARK OFFICE

CERTIFICATE OF CORRECTION

PATENT NO. : 5,504,272

DATED : April 2, 1996

INVENTOR(S) : MASAKI UCHIYAMA ET AL.

It is certified that error appears in the above-identified patent and that said Letters Patent is hereby corrected as shown below:

COLUMN 27

Line 26, "the the" should read --the--.

COLUMN 28

Line 12, "has" should read --had--.
Line 17, "hereafetr." should read --hereafter.--.
Line 36, "reaction,the" should read --reaction, the--.

COLUMN 30

Line 33, "Tables 2." should read --Table 2.--.
Line 63, "Magnetic iron oxide of" should read --Iron oxide of--.

COLUMN 31

Line 12, "futher" should read --further--.

COLUMN 33

Table 3, "5'μm/Vol(%)" should read --5 μm/Vol(%)--.
Table 3, "8,20" should read --8.20--.

COLUMN 34

Line 66, "roller 22" should read --sleeve 22--.

UNITED STATES PATENT AND TRADEMARK OFFICE

CERTIFICATE OF CORRECTION

PATENT NO. : 5,504,272

DATED : April 2, 1996

INVENTOR(S) : MASAKI UCHIYAMA ET AL. Page 5 of 5

It is certified that error appears in the above-identified patent and that said Letters Patent is hereby corrected as shown below:

COLUMN 35

Line 30, "valuation" should read --evaluation--.

COLUMN 36

Line 3, "has" should read --had--.
Line 21, "has" shoudl read --had--.

COLUMN 37

Table 4, "Reproduc" should read --Reproduc- --.
Line 63, "claim 11," should read --claim 1,--.

Signed and Sealed this

Third Day of September, 1996

Bruce Lehman

*Attest:*

BRUCE LEHMAN

*Attesting Officer*

*Commissioner of Patents and Trademarks*